US007625047B2

(12) United States Patent
Bertele

(10) Patent No.: US 7,625,047 B2
(45) Date of Patent: Dec. 1, 2009

(54) KITS FOR USE IN FORMING THREE-DIMENSIONAL ARTICLES, PARTICULARLY ARTICLES OF FURNITURE, FROM FLAT CARDBOARD SHEETS

(75) Inventor: Nitzan Bertele, Tel-Aviv (IL)

(73) Assignee: Krooom Ltd., Tel Aviv (IL)

( * ) Notice: Subject to any disclaimer, the term of this patent is extended or adjusted under 35 U.S.C. 154(b) by 219 days.

(21) Appl. No.: 11/648,799

(22) Filed: Jan. 3, 2007

(65) Prior Publication Data

US 2008/0157582 A1 Jul. 3, 2008

(51) Int. Cl.
*A47C 7/02* (2006.01)
*A47C 7/00* (2006.01)

(52) U.S. Cl. ..... 297/440.12

(58) Field of Classification Search ..... 297/440.12
See application file for complete search history.

(56) References Cited

U.S. PATENT DOCUMENTS 3,121,588 A * 2/1964 Beckman et al. .... 297/440.12 X
3,178,227 A * 4/1965 Snyder ..... 297/440.12
3,250,570 A * 5/1966 Smith et al. ..... 297/440.12
3,331,634 A 7/1967 Harrison, Jr.
3,566,808 A * 3/1971 Slate et al. ..... 297/440.12 X
3,640,575 A * 2/1972 Dosi ..... 297/440.12
3,727,979 A * 4/1973 Schier et al. ..... 297/440.12
3,729,244 A * 4/1973 Butler ..... 297/440.12 X
3,837,719 A * 9/1974 Barron ..... 297/440.12 X
3,861,579 A 1/1975 Manis et al.
3,866,550 A * 2/1975 Geschwender ..... 297/440.12 X
3,960,313 A 6/1976 Sax et al.
4,067,615 A 1/1978 Gehry
4,085,970 A * 4/1978 Klein ..... 297/440.12
4,340,251 A * 7/1982 Geoffroy-Dechaume..297/440.12
4,463,997 A 8/1984 Densen
4,546,941 A * 10/1985 Hildebrand ..... 297/440.12 X
4,648,658 A * 3/1987 Calco ..... 297/440.12
4,813,744 A * 3/1989 Scalisi et al. ..... 297/440.12
4,841,882 A * 6/1989 Ehrman ..... 297/440.12 X
4,875,737 A * 10/1989 Cardenas ..... 297/440.12
4,934,256 A 6/1990 Moss et al.
4,984,848 A * 1/1991 Scalisi et al. ..... 297/440.12
5,143,431 A 9/1992 Udell
5,382,081 A * 1/1995 Henry ..... 297/440.12
5,682,623 A * 11/1997 Fenoglio ..... 297/440.12 X
5,697,675 A * 12/1997 DeWitt et al. ..... 297/440.12
5,795,027 A * 8/1998 Howard et al. ..... 297/440.12
6,048,032 A * 4/2000 Stewart ..... 297/440.12
6,083,580 A 7/2000 Finestone et al.
6,161,901 A * 12/2000 Avner ..... 297/440.12
6,206,473 B1 * 3/2001 Kondratiev ..... 297/440.12 X

FOREIGN PATENT DOCUMENTS

AT 384538 11/1987
DE 1966824 8/1967
FR 2848794 6/2004

* cited by examiner

*Primary Examiner*—Rodney B White
(74) *Attorney, Agent, or Firm*—Roach Brown McCarthy & Gruber, P.C.; Kevin D. McCarthy

(57) ABSTRACT

A kit for use in producing a three-dimensional article from flat cardboard sheets, includes: a cardboard assembly of flat cardboard sheets, each cut according to a predetermined configuration and formed with a predetermined arrangement of fold lines such as to permit the cardboard assembly to be folded from a flat condition for shipping and handling, to a three-dimensional condition defining a three-dimensional article having dimensional stability, structural rigidity and a pleasing appearance. Disclosed, for purposes of example, are kits for producing a stool, a chair, a desk and a table.

19 Claims, 26 Drawing Sheets

KITS FOR USE IN FORMING THREE-DIMENSIONAL ARTICLES, PARTICULARLY ARTICLES OF FURNITURE, FROM FLAT CARDBOARD SHEETS

RELATED APPLICATION

This application is related to U.S. application Ser. No. 11/648,798, concurrently filed with the instant application titled "Base Sheet Of Corrugated Cardboard Or Other Stiff Sheet Material For Use In Forming Various Three-Dimensional Articles, And Kit Including Same", and assigned to the same assignee as the instant application.

FIELD AND BACKGROUND OF THE INVENTION

The present invention relates to kits for use in forming three-dimensional articles from flat cardboard sheets. The invention is particularly useful for forming various articles of children furniture, and is therefore described below with respect to such an application.

Cardboard sheets (e.g. corrugated cardboard sheets), widely used in constructing inexpensive, light-weight containers, have also been used for constructing various articles of furniture, particularly for children, and have also been supplied in kit form for this purpose. Examples of such cardboard kits are described in U.S. Pat. Nos. 4,067,615, 4,934,756 and 6,083,580. However, such kits for making three-dimensional articles, particularly articles of children furniture, have not found widespread use because of the difficulty in producing kits that can be supplied in a compact flat condition for shipping, handling or storage, to be assembled into a three-dimensional article having dimensional stability and structural rigidity, and yet provide a pleasing appearance.

OBJECTS AND BRIEF SUMMARY OF THE PRESENT INVENTION

An object of the present invention is to provide a kit for use in forming three-dimensional articles from flat cardboard sheets having important advantages particularly with respect to fold ability into a compact flat form for storage, shipping or handling as well as dimensional stability and structural rigidity when assembled in the three-dimensional article, and also provide a pleasing appearance in the assembled article.

According to a broad aspect of the present invention, there is provided a kit for use in forming a three-dimensional article from flat cardboard sheets, comprising: a cardboard assembly of flat cardboard sheets, each cut according to a predetermined configuration and formed with a predetermined arrangement of fold lines such as to permit the cardboard assembly to be expanded from a flat condition to a three-dimensional condition defining a three-dimensional article; wherein the predetermined arrangement of fold lines includes: first fold lines permitting the cardboard assembly to be folded from the flat condition to a three-dimensional condition to define a peripheral side wall of the three-dimensional article; and second fold lines spaced inwardly of viewable edges of the peripheral side wall defining flaps bent inwardly and joined to the inner surface of the peripheral side wall, such as to present fold lines, rather than cut edges, at the viewable edges of the peripheral side wall.

According to further features in the described preferred embodiments, the cardboard assembly includes two (or more) cardboard units joined together at their opposite ends by thin flexible connector strips of smaller thickness than that of the cardboard in the cardboard assembly, such as to permit the cardboard assembly to be folded to a flat condition without unduly stressing the fold lines at the opposite ends. Each of the two cardboard units of the cardboard assembly includes a plurality of flat cardboard sheets joined together at predetermined surfaces thereof. Preferably, the flaps defined by the second fold lines are adhesively joined to the inner surfaces of the peripheral side wall.

In some described embodiments, the cardboard assembly includes an extension at least at one end defined by a third fold line, permitting the extension to be folded over the respective end of the peripheral side wall and thereby to constitute an end wall of the peripheral side wall. A second extension is provided at the opposite end defined by another third fold line, permitting the second extension also to be folded over the respective end of the peripheral side wall and thereby to constitute a second end wall thereof.

Another embodiment is described wherein the open end of the peripheral side wall is defined by a separate cardboard sheet.

According to still further features in the described embodiments the end wall applied over the peripheral side wall, whether folded over or separately applied, is formed with fourth fold lines spaced inwardly of the outer edges of the end wall to define bendable flaps receivable against the inner surface of the respective end of the peripheral side wall for retaining the end wall in place over the peripheral side wall.

The kit described in some embodiments includes further cardboard sheets configured and formed with a predetermined arrangement of slits such as to permit the further cardboard sheets inserted within the peripheral side wall to structurally reinforce the three-dimensional article. The further flat cardboard sheets may be inserted in the form of an egg-crate array or of a radiating array.

In the described embodiments, all edges exposed to view are folded edges, rather than cut edges, and all surfaces of the cardboard sheets which are exposed to view in the three-dimensional article are colored or otherwise ornamented. Such an article thus provides a very pleasing appearance hardly indicative that it is of a cardboard construction.

For purposes of example, the invention is described below for assembling a stool, a chair, a desk, and a table, but it will be appreciated that the invention could be used for assembling many other articles.

Further features and advantages of the invention, as well as other applications of the invention, will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF PREFERRED EMBODIMENTS

Figure 1A:
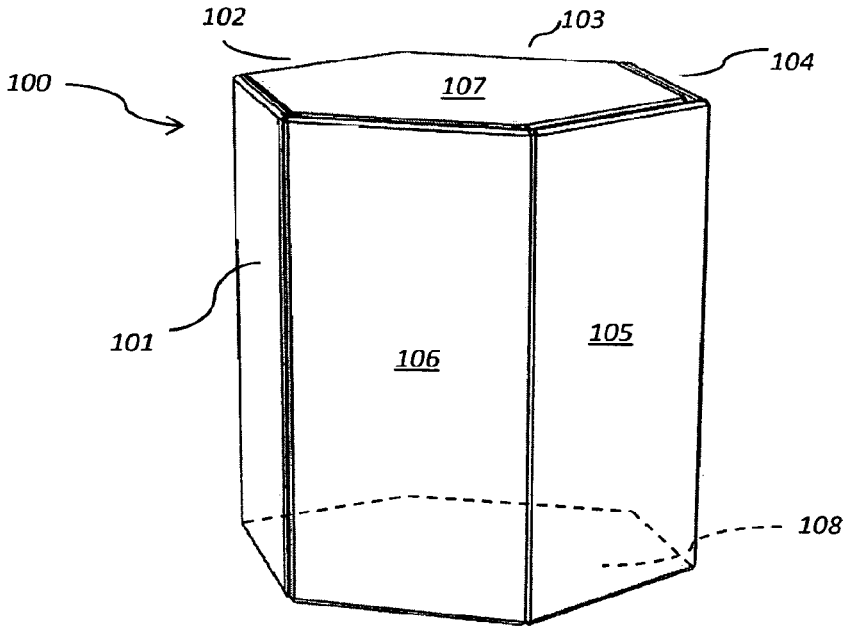
FIGS. 1*a*-1*n* illustrate the various components of a kit for assembling a stool, and the various steps in assembling the stool.
Figure 1B:
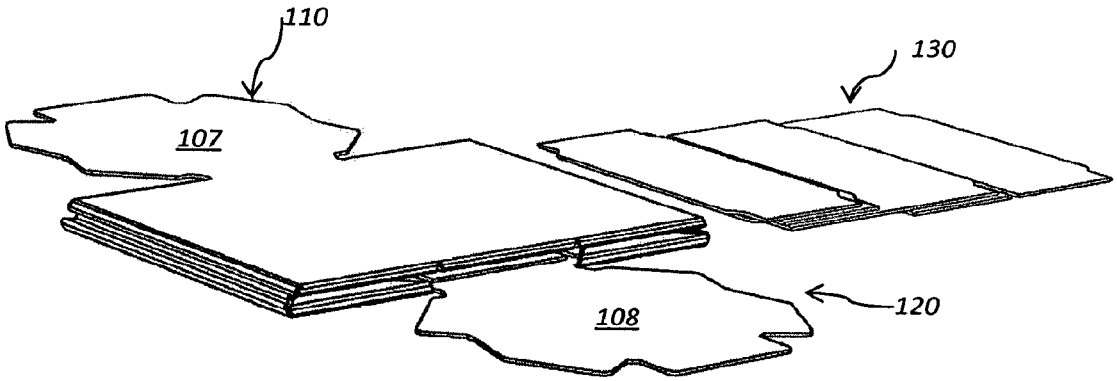
Figure 1C:
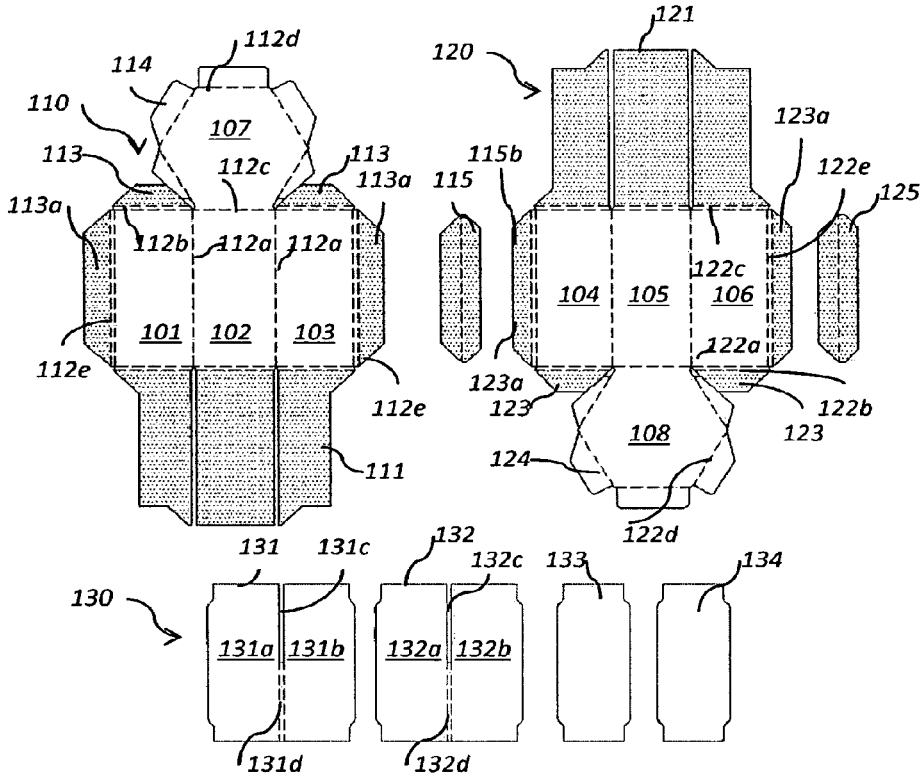
Figure 1D:
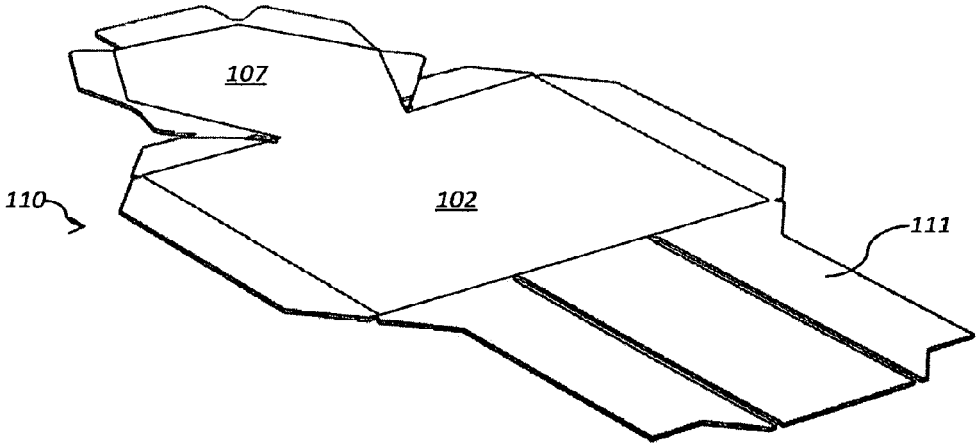
Figure 1E:
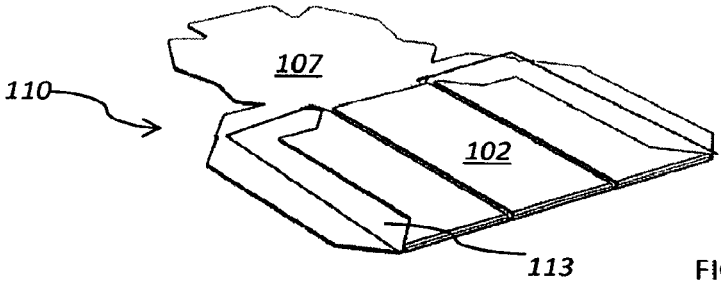
Figure 1F:
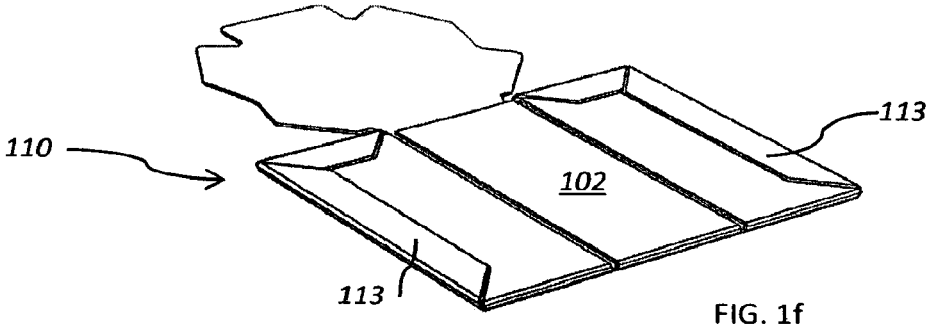
Figure 1G:
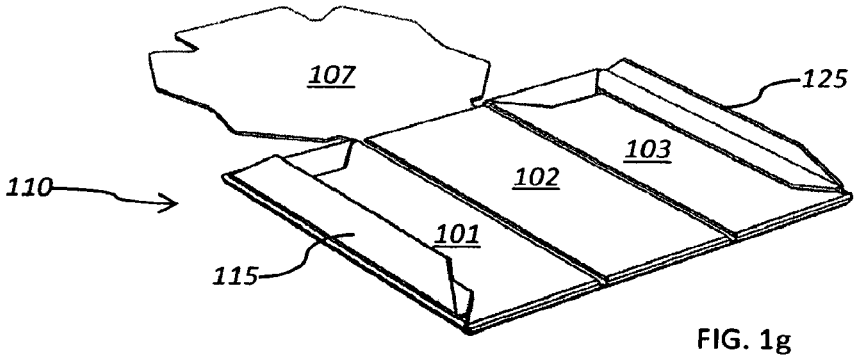
Figure 1H:
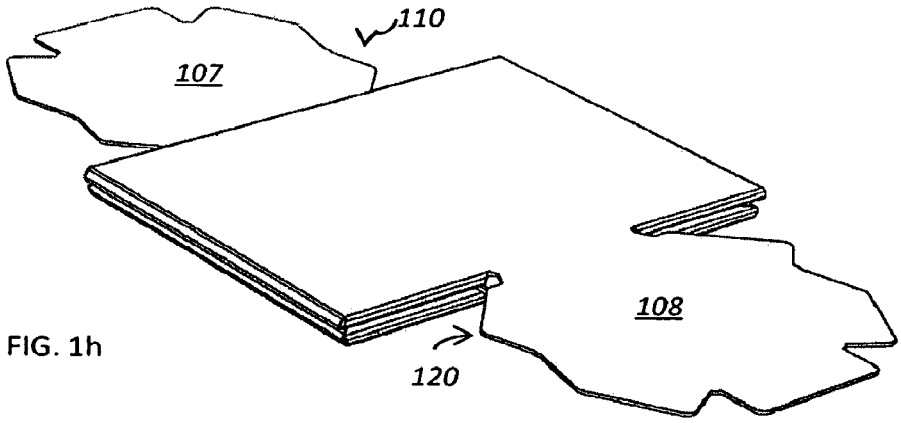
Figure 1I:
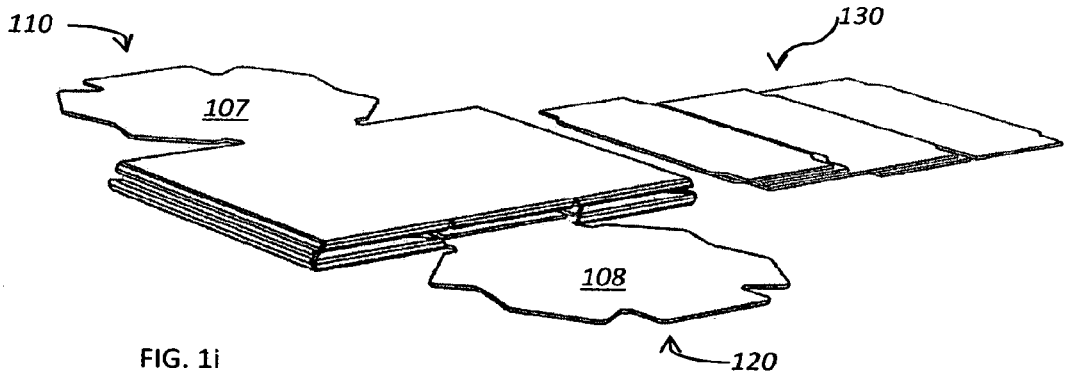
Figure 1J:
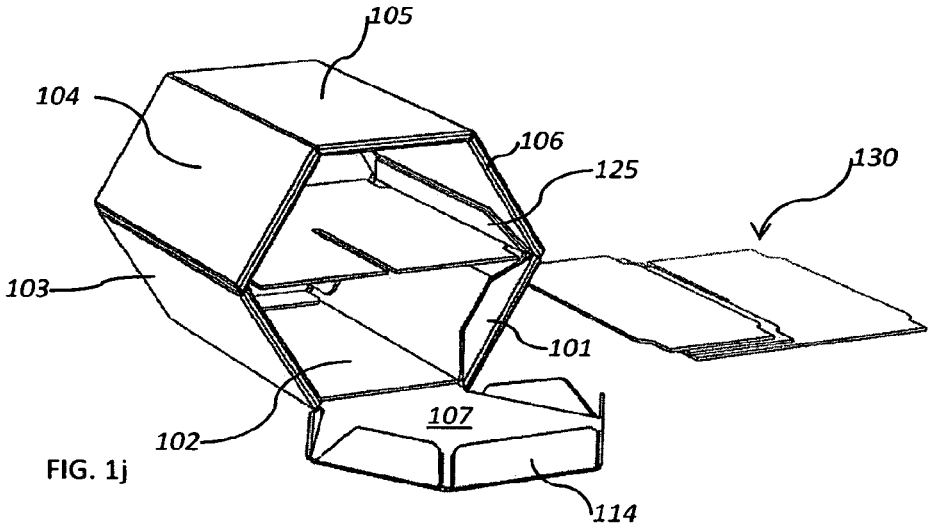
Figure 1K:
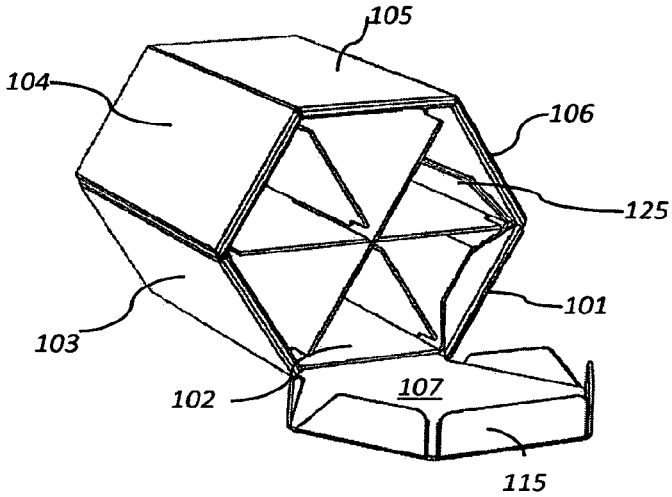
Figure 1L:
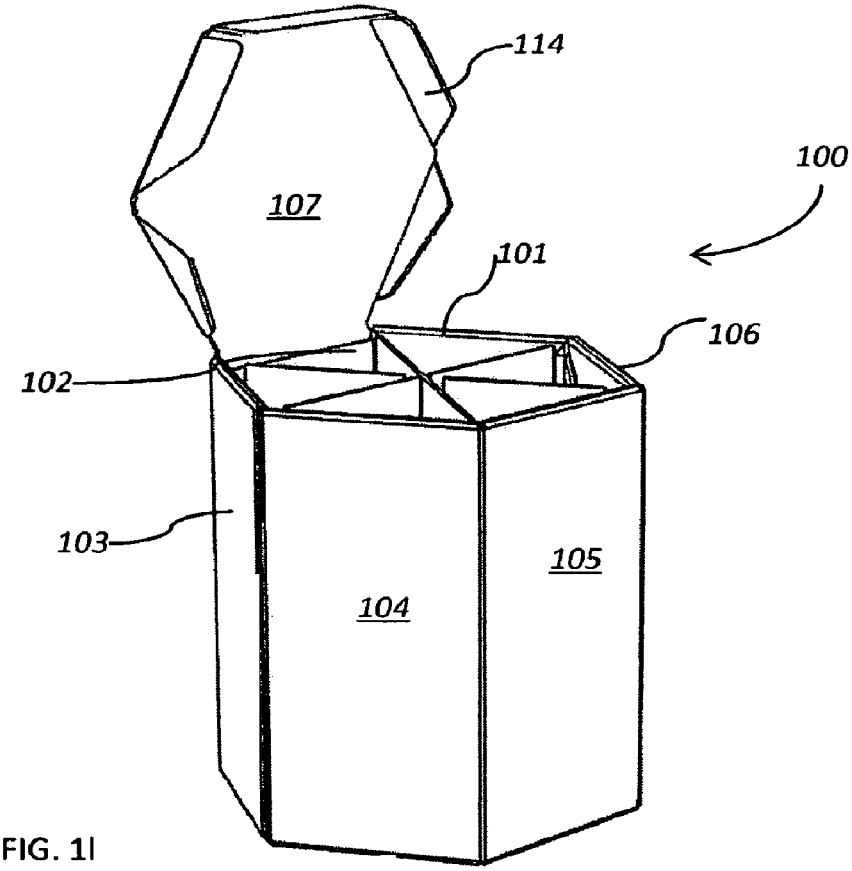
Figure 1M:
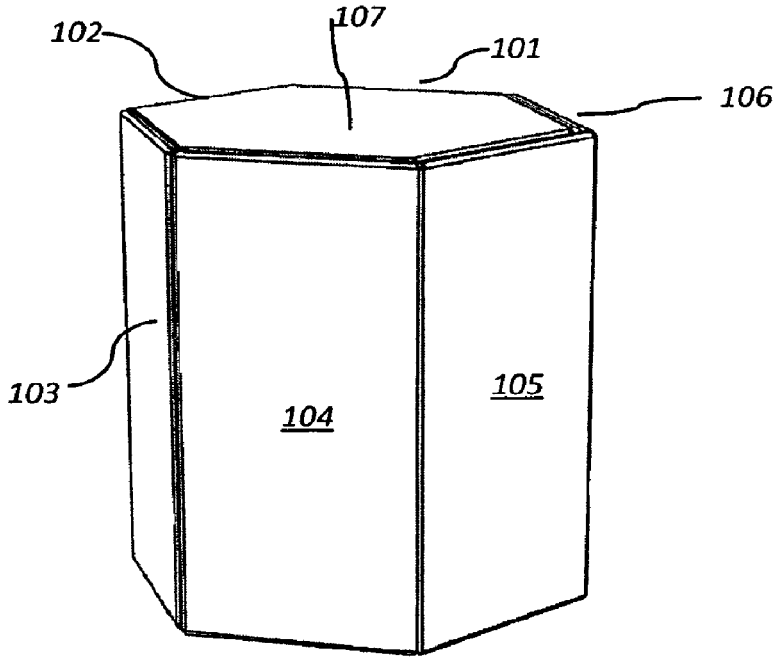
Figure 1N:
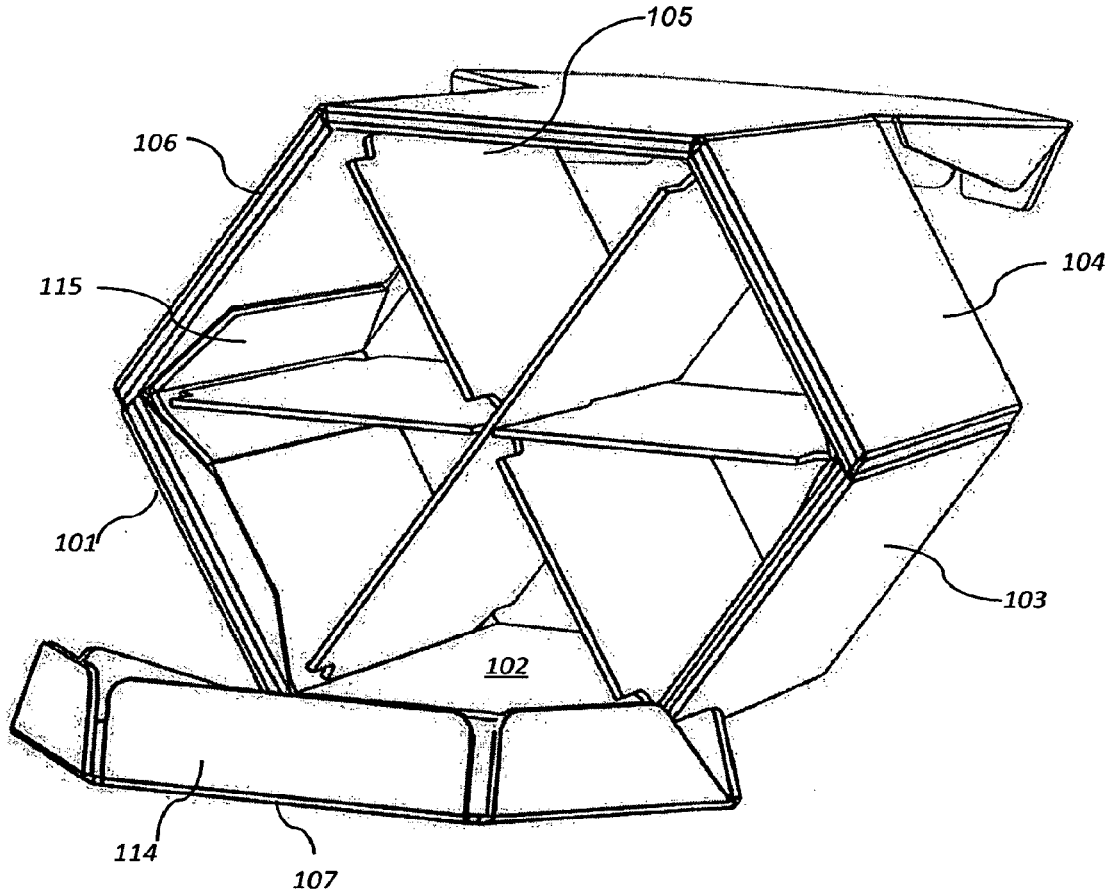

The Stool Embodiment (FIGS. 1*a*-1*n*)

FIGS. 1*a*-1*n* illustrates a kit for use in assembling a stool, generally designated 100 in FIG. 1*a*. Such a kit includes three cardboard units or sub-assemblies, generally designated 110, 120 and 130, respectively, in FIG. 1*b*. The construction of each such sub-assembly or unit is more particularly illustrated in FIG. 1*c*, which shows the various cardboard sheets in flat form. FIG. 1*c* also illustrates, by dotted lines, the surfaces of the two units 110 and 120 which are to be adhesively joined to each other to produce the assembly in FIG. 1*b* to be used in making the stool 100 in FIG. 1*a*.

Each sheet of the assembly is cut according to a predetermined configuration and is formed with a predetermined arrangement of fold lines to enable the assembly to be expanded from the flat condition of FIG. 1*b* to the three-dimensional condition defining the stool 100 of FIG. 1*a*.

As shown in FIG. 1*a*, the three-dimensional stool 100 to be formed by the cardboard sheets within the kit includes a peripheral array of side walls 101-106, closed at one end by a top wall 107, and at the opposite end by a bottom wall 108. In the example illustrated, the peripheral side wall is of hexagonal configuration, including the six sides 101-106; accordingly, the two end walls 107, 108 would also be of hexagonal configuration.

The peripheral side walls 101-106 and the two end walls 107, 108, are defined by the two units 110, 120 (FIG. 1*c*) when joined together. The flat cardboard sheets of unit 130 (FIG. 1*c*) are disposed within the stool 100, as shown as example in FIG. 1*k*, to structurally reinforce the stool when assembled.

The construction of each of the two units 110, 120 is more particularly illustrated in a flat condition in FIG. 1*c*. Thus, unit 110 includes the three side walls 101-103, together with the top wall 107, whereas unit 120 includes the remaining three side walls 104-106, and the bottom all 108. Unit 110 further includes a section 111, on the side opposite to top wall 107, which is adhesively joined to a corresponding section 121 in unit 120 defining the opposite side including bottom wall 108, to produce the sub-assembly illustrated in FIG. 1*b*.

As further seen in FIG. 1*c*, both units 110 and 120 are formed with a first group of fold lines 112*a*, 122*a*, permitting the assembly of the two units 110, 120 to be folded to define the six side walls 101-106 around the periphery of the stool 100. In addition, the two units 110, 120 are formed with second fold lines 112*b*, 122*b*, respectively, spaced inwardly of the edges of the peripheral side wall defined by sides 101-106, defining flaps 113, 123, respectively, which are bent inwardly and are joined to the inner surfaces of the peripheral side wall at its two opposite ends. Such flaps 113, 123 thereby present fold lines, rather than cut edges, at the edges of the stool viewable by the user.

The two units 110, 120 are further formed with another fold line (hereinafter a third fold line), 112*c*, 122*c*, respectively, permitting their respecting extensions 107, 108, to be folded over the respective end of the peripheral side wall defined by sides 101-106, and thereby to constitute the top and end walls, respectively, of the stool. Each unit 110, 120, is formed with a further fold line 112*c*, 122*c* (also referred to as a third fold line) permitting adhesive-containing extensions 111 and 121, respectively, to be folded, and to be adhesively joined together in the assembled stool.

Each of the latter extensions defining the top wall 107 and bottom wall 108, respectively, is further formed with fourth fold lines 112*d*, 122*d*, respectively, spaced inwardly of the outer edges of the extension to define bendable flaps 114, 124, respectively, which are receivable against the inner surface of the respective end of the peripheral side wall defined by sides 101-106, for frictionally retaining the extensions defining the top and bottom walls 107, 108, in the place at the respective end of the peripheral side wall.

The two cardboard units 110, 120 are adhesively joined together by side flaps 113*a*, 123*a* defined by fold lines 112*e*, 122*e*, at each end of each unit. The corrugated cardboard used for cardboard units 110, 120, are relatively thick, in the order of 5 mm. When the two units 110, 120 are adhesively joined together at their side flaps 113*a*, 123*a* and flattened, this would put a considerable strain on the fold lines 112*e* and 122*e* because of the thickness of the cardboard sheets. To avoid this strain, and particularly to permit the two units, when joined together, to be substantially flattened as shown in FIG. 1*b*, two of the side flaps 113*a*, 123*a* at one end are adhesively joined together by a connector strip 115, and at the opposite end by a second connector strip 125. These connector strips are of substantially thinner construction and are adhesively joined to the inner surfaces of the side flaps 113*a*, 123*a* as shown particularly in FIG. 1*j*, such that they permit the two units 110, 120 to be completely flattened without unduly straining the fold lines 112*e*, 122*e* at the respective ends of the units.

As indicated earlier, the further cardboard sheets 130 are inserted into the interior of the stool defined by the side walls 101-106, from one end, e.g. while the top wall 107 is still in its open condition as shown in FIGS. 1*j* and 1*k*. FIG. 1*c* illustrates unit 130 as including four sheets 131-134. Sheets 131 and 132 are double sheets, divided into two sections 131*a*, 131*b* and 132*a*, 132*b*, respectively, by a slot 131*c*, 132*c*, extending at a mid portion of each sheet half way of the length of the sheet, leaving the other end of the sheet unslotted as shown at 131*d*. The two smaller sheets 133, 134 are each of the size of the two sections 131*a*, 13*b* and 132*a*, 132*b*.

Thus, as shown particularly in FIGS. 1*j* and 1*k*, when inserting sheet 130 into the interior of the stool, sheet 131 is first inserted with its slot 131*c* facing upwardly; sheet 132 is inserted thereover with it unslotted portion 132*d* received within slot 131*c* of sheet 131; and finally the remaining two sheets 133, 134 are inserted in the spaces between sheets 131, 132. Such an arrangement thus provides a radiating array of cardboard sheets within the stool 100, between the top and bottom end walls 107, 108, to thereby substantially increase the strength of the stool to withstand loads.

The manner of using the illustrated kit for assembling the stool 100 will be apparent from the above description. Thus, as indicated earlier, the two connector strips 115, 125 are adhesively joined together at one of the end flaps 114, 124 of the two units 110, 120; and the two units 110, 120 are adhesively joined directly to each other via their other end flaps 114, 124. This may be done at the factory since the relatively thin connector strips 115, 125 permit the two units to assume a compact flattened condition for shipping, handling, etc. as illustrated in FIG. 1*b*. The cardboard sheets 130-134 constituting unit 130 can also be shipped and handled in a flattened condition, as shown in FIG. 1*b*.

The user thus receives the flat assembly of the two units 110, 120, and also the flat sheets of unit 130, as illustrated in FIG. 1*b*. The user then expands the assembly of units 110, 120, to produce a hexagonal peripheral side wall defined by the six side walls 101-106. One of the slotted cardboard sheets 131 is then inserted into the interior of the stool, and then other slotted cardboard sheet 132, with the slot of one sheet receiving the unslotted portion of the other sheet, and with the edges of the four sections 131*a*, 131*b*, 132*a*, 132*b*, seated at the juncture of four of the six sides of the hexagonal peripheral wall. The other two sheets 133, 134, are then inserted into the spaces to engage the remaining junctures of the six side walls.

The flaps 114, 124, defined by fold lines 112*d* and 122*d*, respectively, may then be bent inwardly, as shown in FIGS. 1*j*-1*l*, so that they engage the inner surfaces of the side walls and thereby frictionally retain the respective end walls in place, closing the ends of the stool.

It will thus be seen that the cardboard sheet sub-assemblies illustrated in FIGS. 1*a*-1*n* are easily and conveniently foldable into a compact flat form, e.g., as seen in FIG. 1*b*, for storage, shipping or handling, and are easily expanded into the stool illustrated in FIG. 1*a*. It will also be seen that the stool so produced has a high degree of dimensional stability and structural rigidity, and also has a pleasing appearance since no cut edges are viewable but rather, all viewable edges are in the form of bond lines. The surfaces of the cardboard sheets which are exposed to view in the so-formed stool are preferably colored or otherwise ornamented.

The Chair Embodiment (FIGS. 2*a*-2*i*)

Figure 2A:
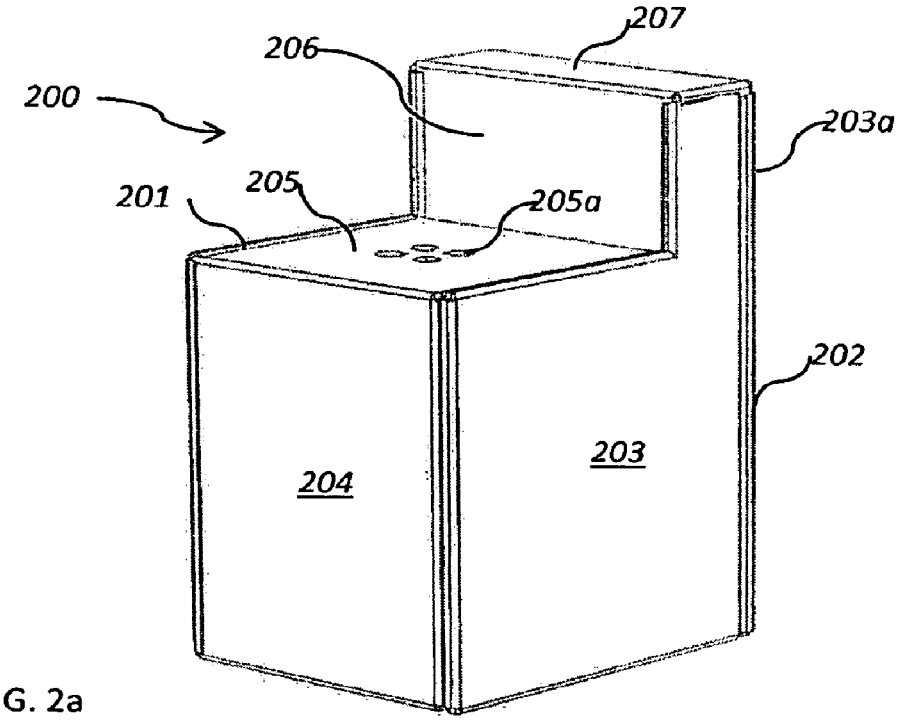
FIGS. 2*a*-2*i* illustrate the various components of a kit for assembling a chair, and the various steps in assembling the chair.

FIGS. 2*a*-2*i* illustrates a kit constructed in accordance with the present invention for use in making a chair, generally designated 200 in FIG. 2*a*. Such a chair includes four side walls 201, 204, an end wall 205 serving as seat for the user, a vertically-extending sidewall 206 serving as a backrest, and a top end wall 207. The cardboard kit for use in making the chair 200 of FIG. 2*a* includes basically the same components as the kit in making the stool of FIGS. 1*a*-1*n*, except that the cardboard sheets are of a shape, and are provided with fold lines, to permit them to be expanded from their flattened condition into a chair, as shown at 200 in FIG. 2*a*.

Figure 2B:
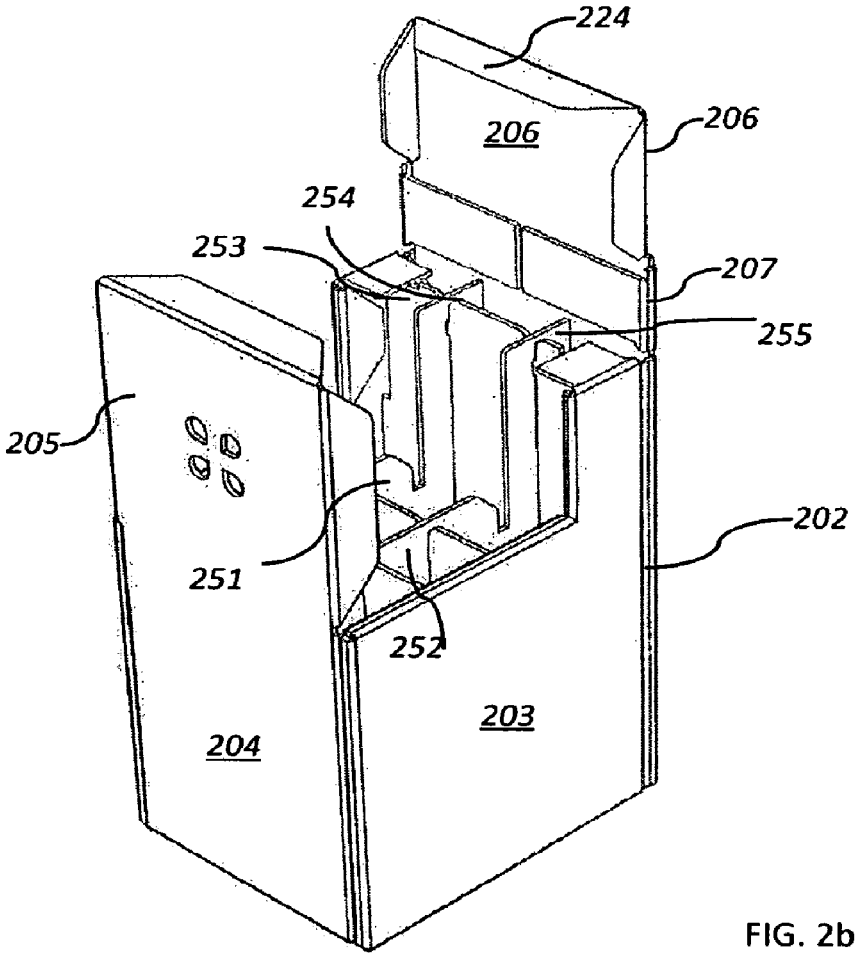
Figure 2C:
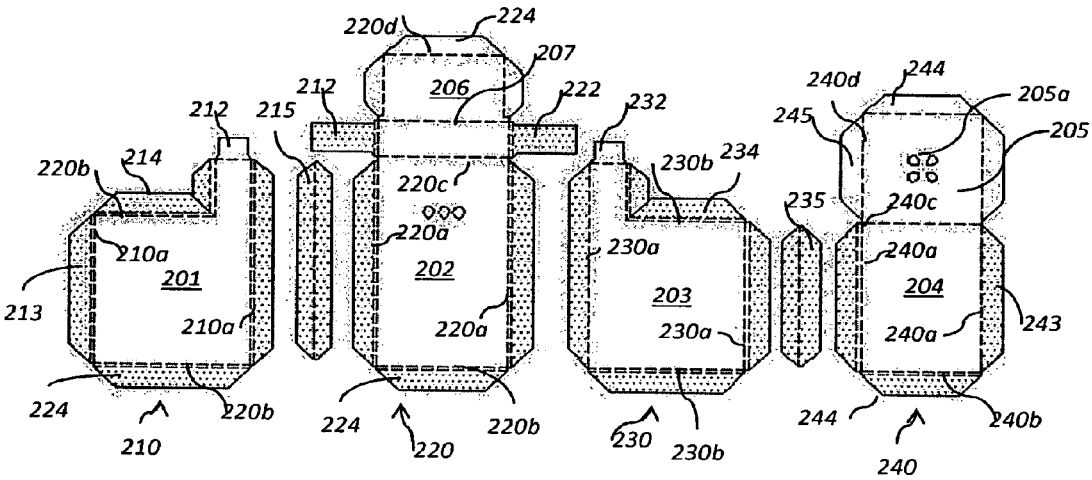
Figure 2C:
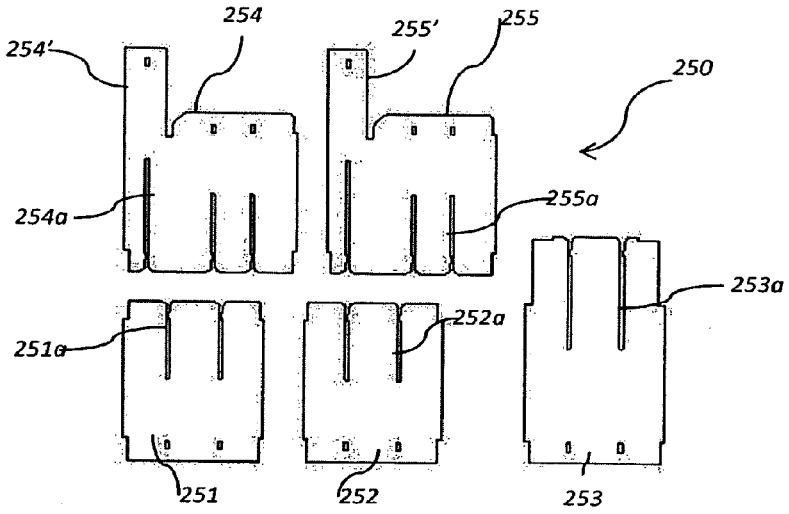
Figure 2D:
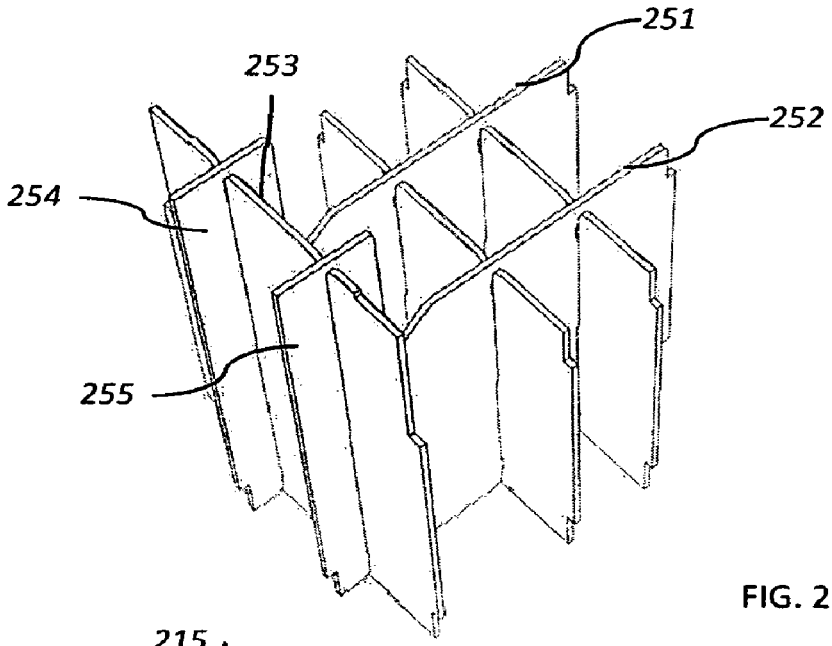
Figure 2E:
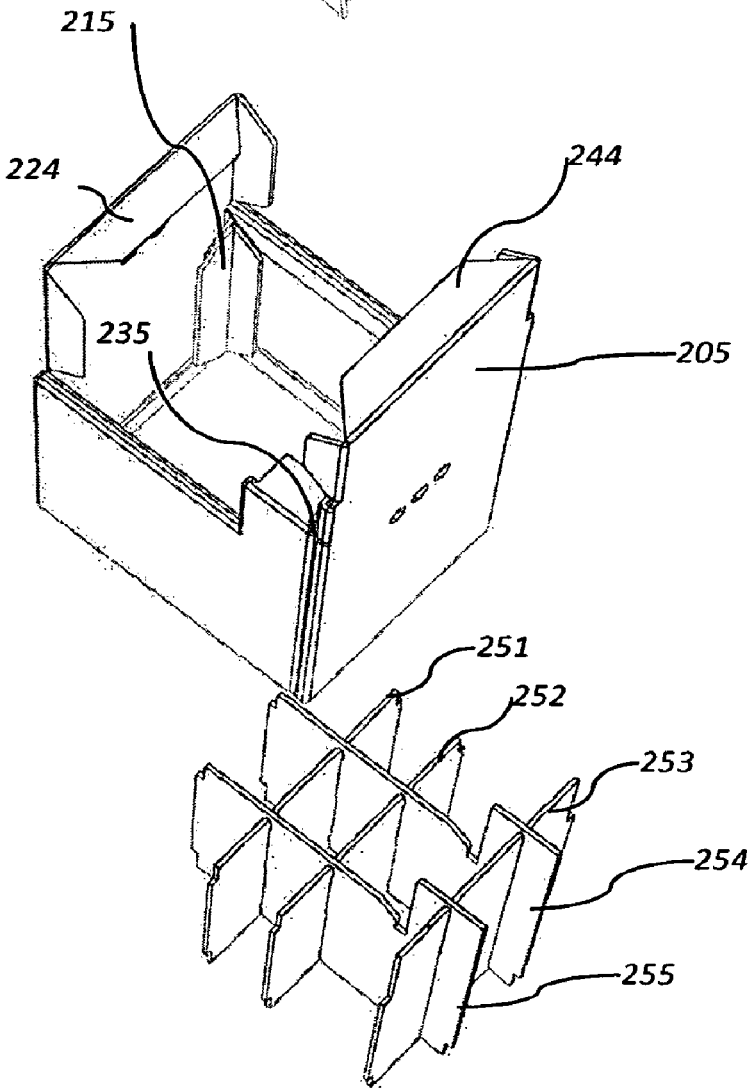
Figure 2F:
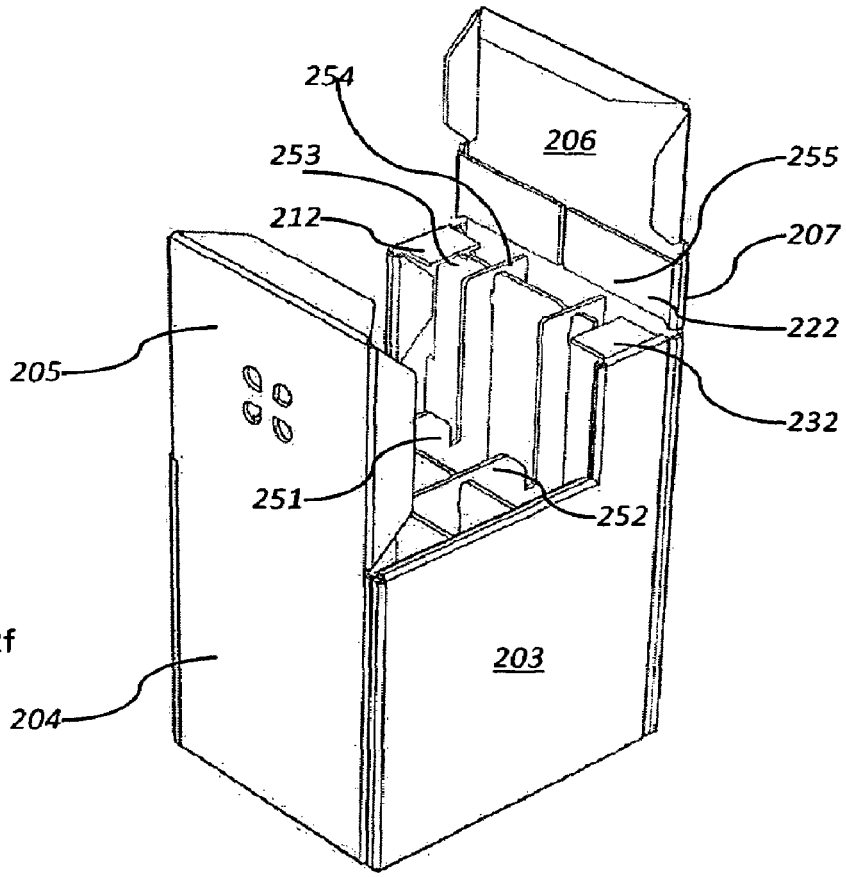
Figure 2G:
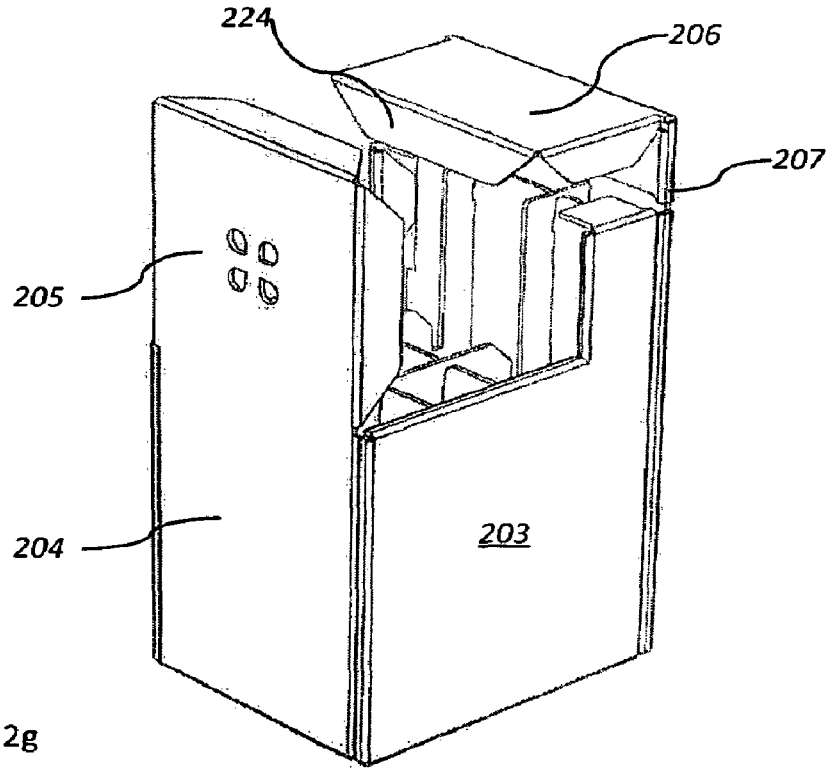
Figure 2H:
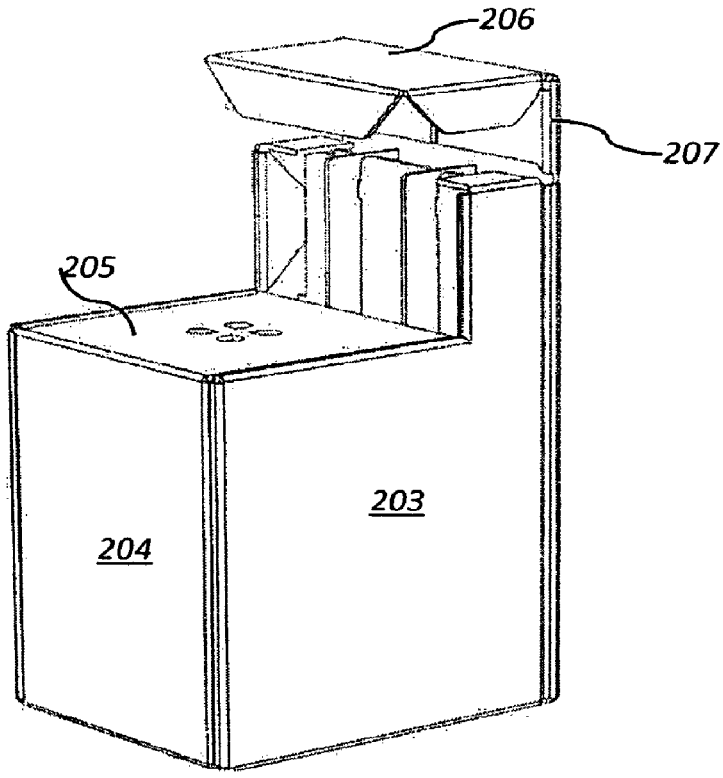
Figure 2I:
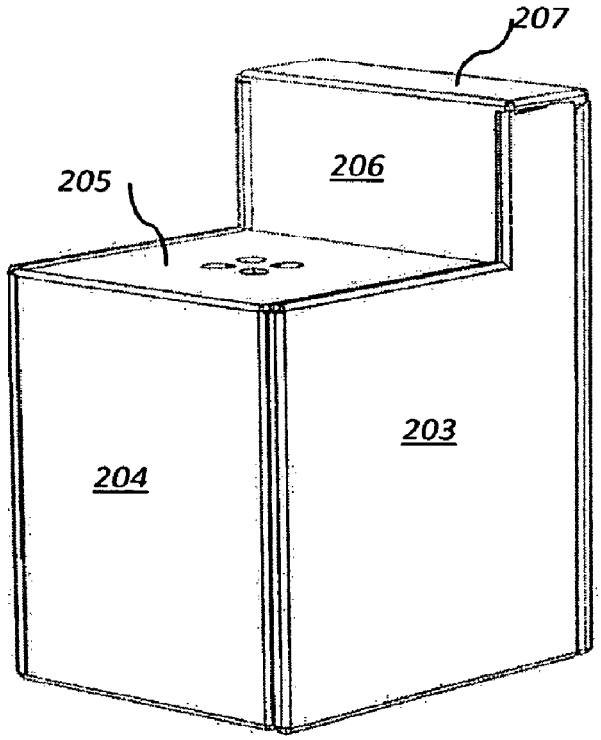

FIG. 2*c* illustrates the basic components of the kit to enable assembling the chair 200 of FIG. 2*a*. In this case, the kit includes four cardboard units 210, 220, 230 and 240, for producing the outer configuration of the chair 200, and five cardboard sheets 251-255, constituting the inner reinforcement unit 250 receivable within the interior of the chair to increase the physical strength of the chair against loads.

Thus, as shown in FIG. 2*c*, cardboard unit 210 defines the left side wall 201 together with its backrest extension 201*a*; unit 220 defines the back side wall 202, together with its backrest extension 202*a*, top wall 207, and vertical wall 206 of the backrest; unit 230 defines the right side wall 203 together with its backrest extension 203*a*; and unit 240 defines the front side wall 204 together with the seat 205. Preferably, seat 205 is formed with finger-receiving apertures 205*a* to facilitate manipulating the seat, or the chair, if desired.

In this case, the unit 210 is joined to unit 220 by a thin connector strip 215, and unit 230 is joined to unit 240 by another thin connector strip 235. In addition, unit 210 is joined to unit 240 via flaps 213 and 243; and unit 220 is joined to unit 230 via flaps 223, 243.

The first fold lines, permitting the cardboard assembly of units 210-240 to be shipped, stored or handled in a compact flat condition, and thereafter to be expanded to a three-dimensional condition to define a peripheral side wall, are fold lines 210*a*, 220*a* and 240*a*. The cardboard assembly of units 210-240 is also formed with second fold lines 210*b*, 220*b*, 230*b* and 240*b*, which define flaps 214, 224, 234 and 244, bent inwardly and joined to the inner surfaces of the peripheral side wall by adhesive such as to present fold lines, rather than cut edges, at the viewable edges of the chair.

In addition, the cardboard seat section 240 includes a third fold line 240*c* which permits seat 205 to be folded over the side walls of the lower seat section of the chair and thereby to close the respective end of that section. Seat section 240 also includes the fourth fold lines 240*d* spaced inwardly of the outer edge of the seat section 205 to define bendable flaps 245 which are receivable against the inner surface of the respect end of the seat section for frictionally retaining the seat 205 in place against the end of the seat section.

Back section 220 includes two third fold lines 220*c* to define top wall 206 and back wall 207, and fourth fold lines 220*d* to define flaps 225 corresponding to flaps 245 in seat section 240.

As still further seen in FIG. 2*c*, this top section 207 of unit 220 is formed with flaps 222 on its opposite sides, which flaps are adhesively coated for bonding against the inner surface of section 207, thereby reinforcing this section. In addition, the two units 210, 230, straddling unit 220, are formed with flaps 212 and 232, respectively, which are bent over to engage top section 207 of unit 220, as reinforced by the adhesively secured flaps 222, to provide structural reinforcement to the chair when in its expanded condition as shown in FIG. 2*a*.

As indicated earlier, the flat cardboard sheets constituting unit 250 are used for structurally reinforcing the seat section and back section of the illustrated chair. In this case, this unit includes five flat cardboard sheets 251-255. Cardboard sheets 251 and 252 are of a height for reception within the seat section of the chair; whereas sheet 253 is of a larger height so as to extend also into the backrest section of the chair (FIG. 2*b*). Sheets 254 and 255 include a main section of a height for reception within the seat section of the chair, and an extension, as shown at 254*i* and 255*i*, respectively, for extending into the backrest section of the chair.

As further seen in FIG. 2*c*, and particularly in the assembly view of FIG. 2*b*, each of the reinforcing sheets 251-255 is formed with slots 251*a*-255*a* extending for half the height of the respective section, such that they may be assembled in an egg-crate arrangement within the chair, as shown in FIG. 2*b*.

FIGS. 2*d*-2*i* illustrate the manner of expanding the cardboard assembly including sheets 210-240 to define the external surfaces of chair 200 illustrated in FIG. 2*a*, and the manner of inserting the reinforcement cardboard sheets 251-255 in an egg-crate array into the interior of the chair so as to structurally reinforce the chair with respect to loads.

It will be appreciated that the cardboard sheets illustrated in FIG. 2*c* can be supplied, shipped and stored in a flat, compact condition, this being particularly permitted by the thin connector strips 215, 235, and can be erected in a quick and facile manner to form the chair 200 illustrated in FIG. 2*a* having dimensional stability, structural rigidity and a pleasing appearance such as no cut edges of the cardboard are exposed for view, but only fold lines It will also be appreciated that the surfaces of the cardboard sheets exposed for view in the three-dimensional chair can be colored or otherwise ornamented, thereby providing an extremely pleasing appearance to the chair produced with these cardboard sheets.

The Desk Embodiment (FIGS. 3*a*-3*k*)

Figure 3A:
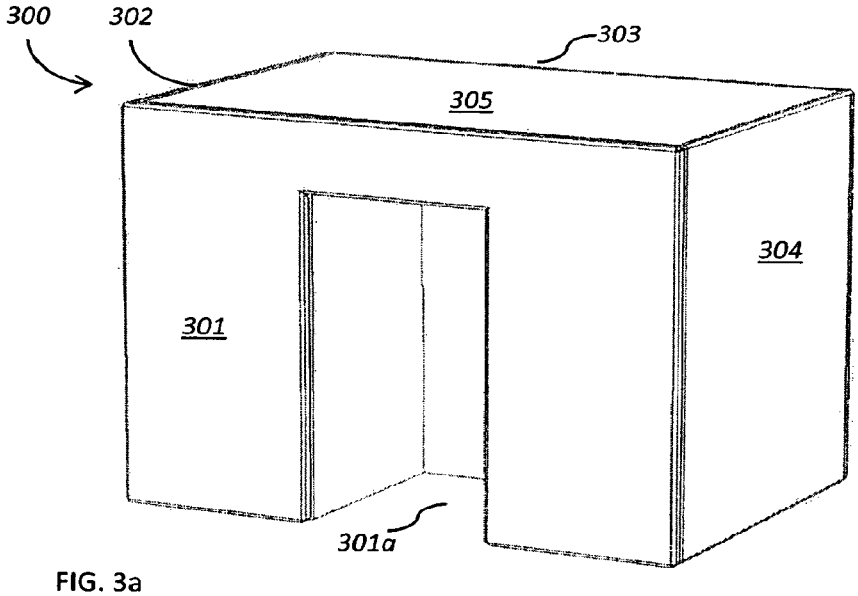
FIGS. 3*a*-3*k* illustrate the various components of a kit for assembling a desk, and the various steps in assembling the desk.
Figure 3B:
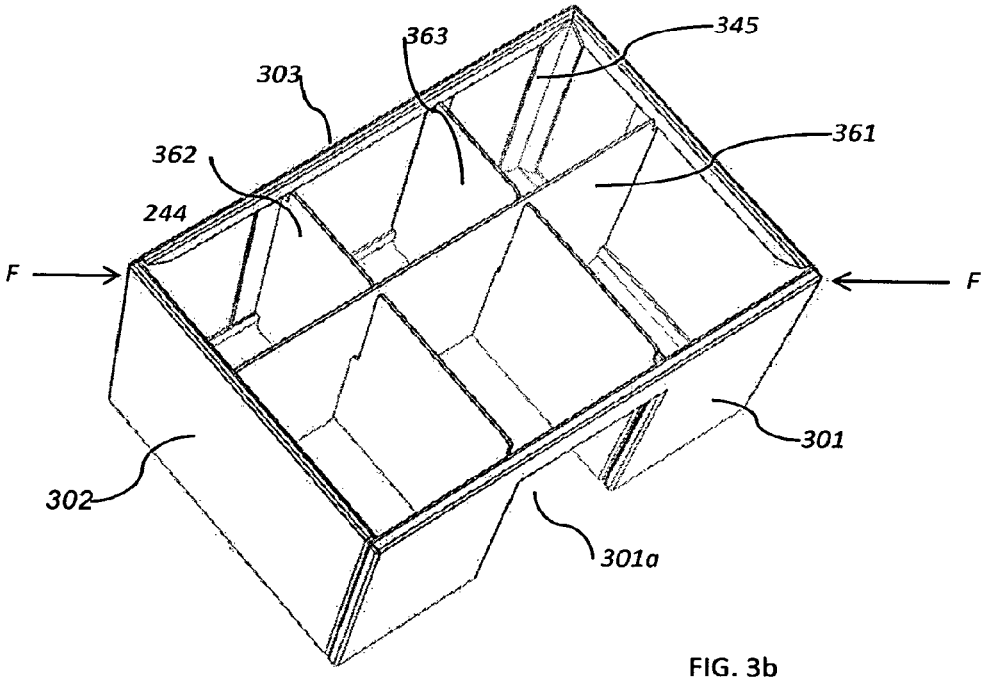

FIGS. 3*a*-3*k* illustrate a cardboard kit for constructing a desk 300 as shown in FIG. 3*a*. The desk, in its expanded condition as illustrated in FIG. 3*a*, includes a front side wall 301, a left-side wall 302, a back side wall 303, a right-side wall 304, and a top wall 305, serving as the top surface of the desk. The front side wall 301 is formed with a rectangular opening 301*a* to accommodate a chair, or the feet of a person sitting on the chair using the desk. FIG. 3*b* illustrates the desk 300 of FIG. 3*a*, but with the top 305 removed.

Figure 3C:
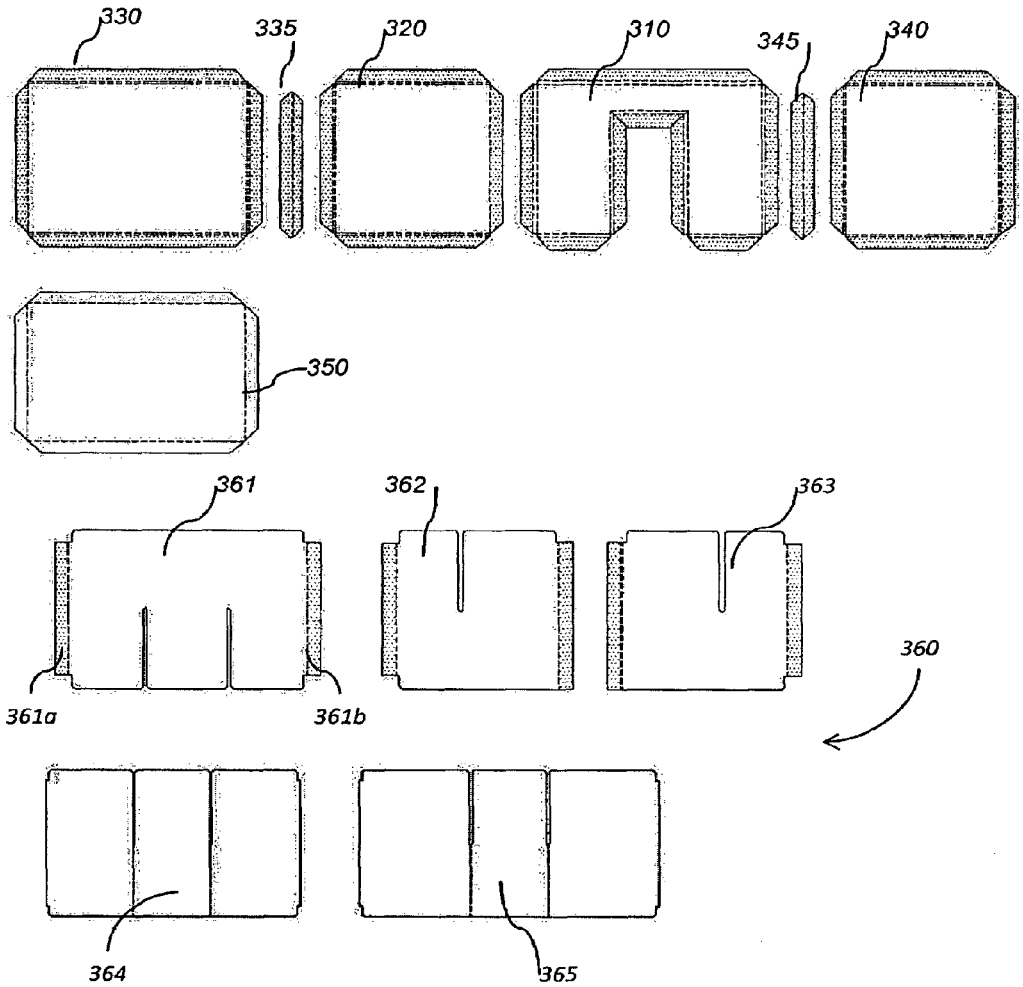
Figure 3D:
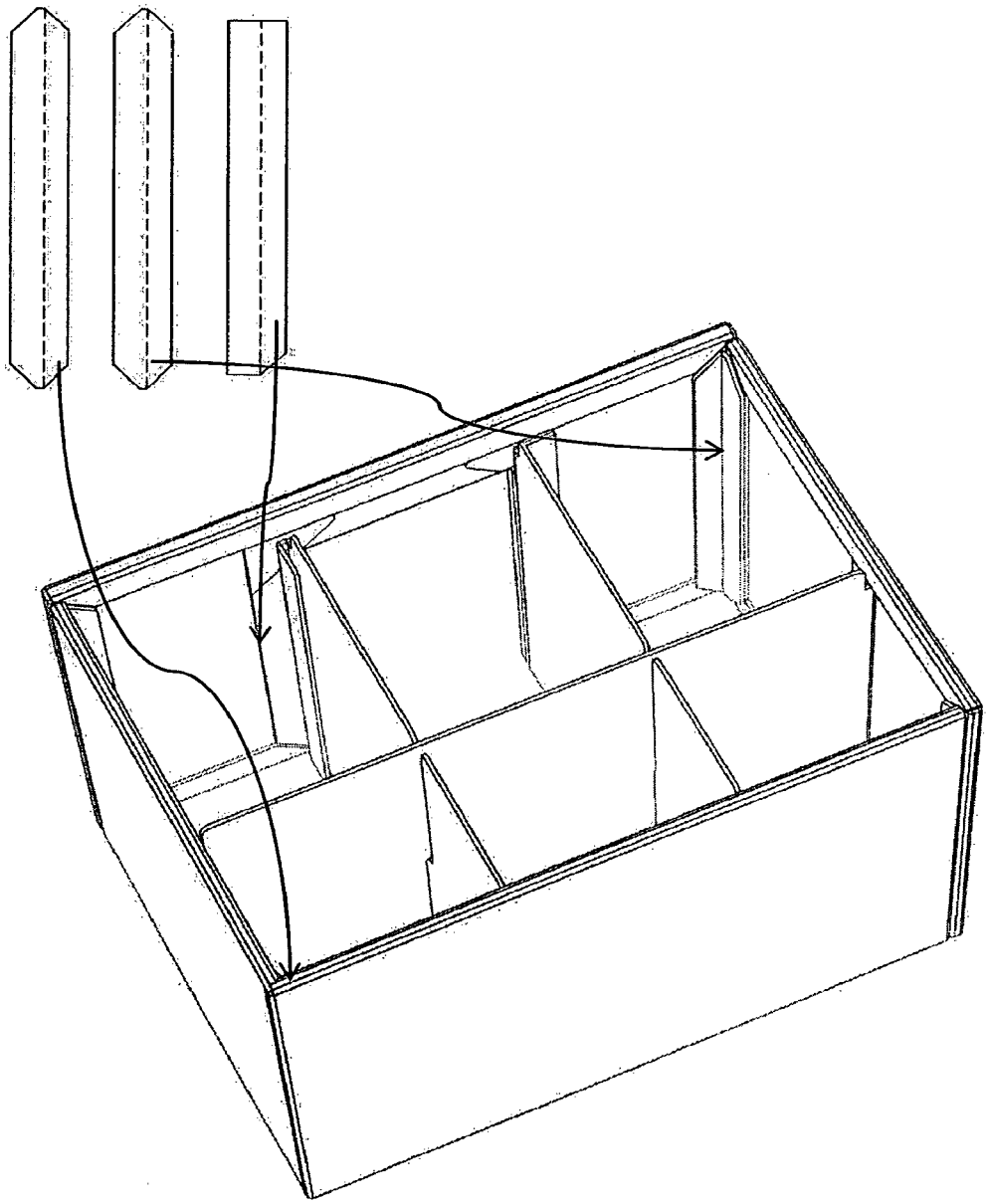
Figure 3E:
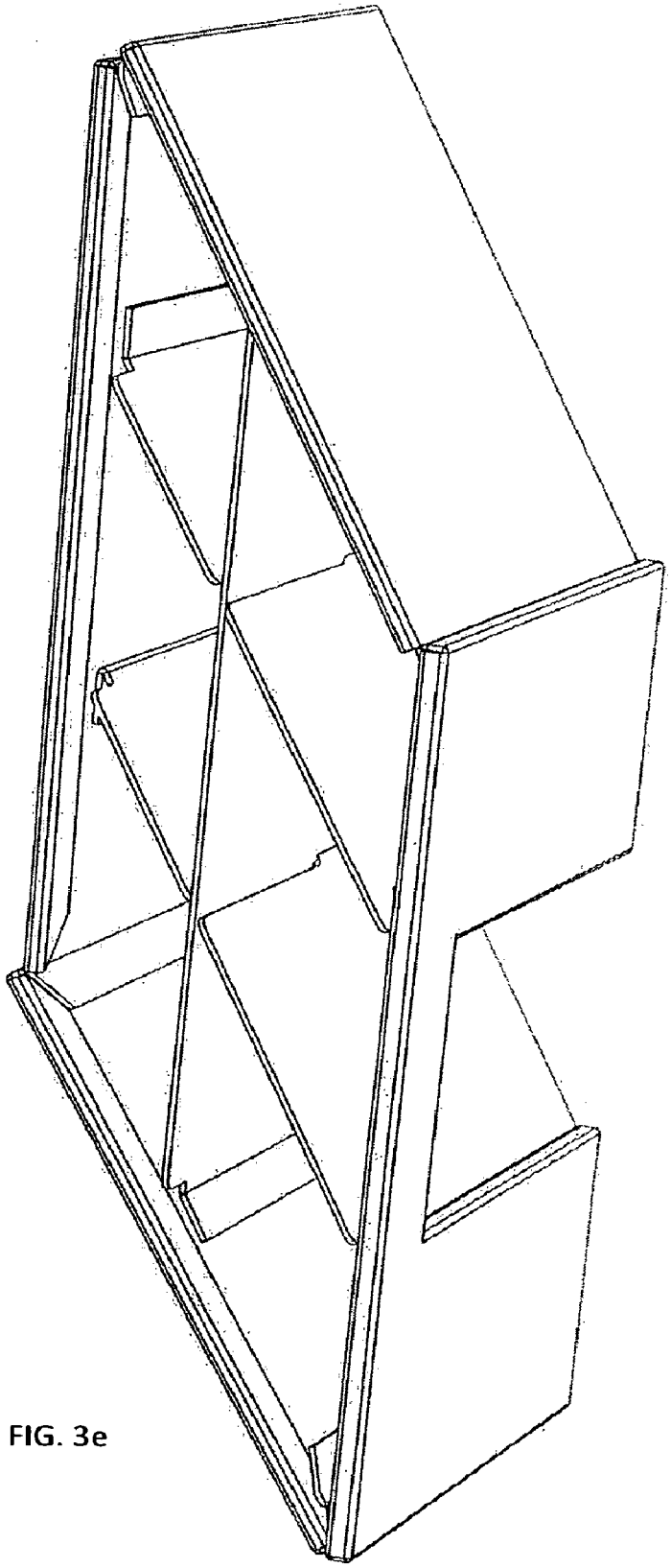
Figure 3F:
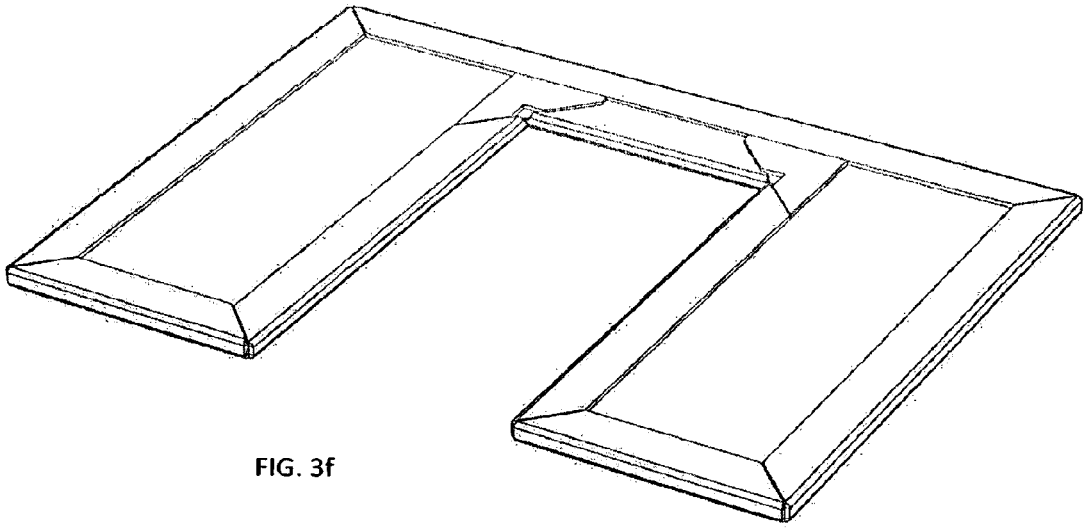
Figure 3G:
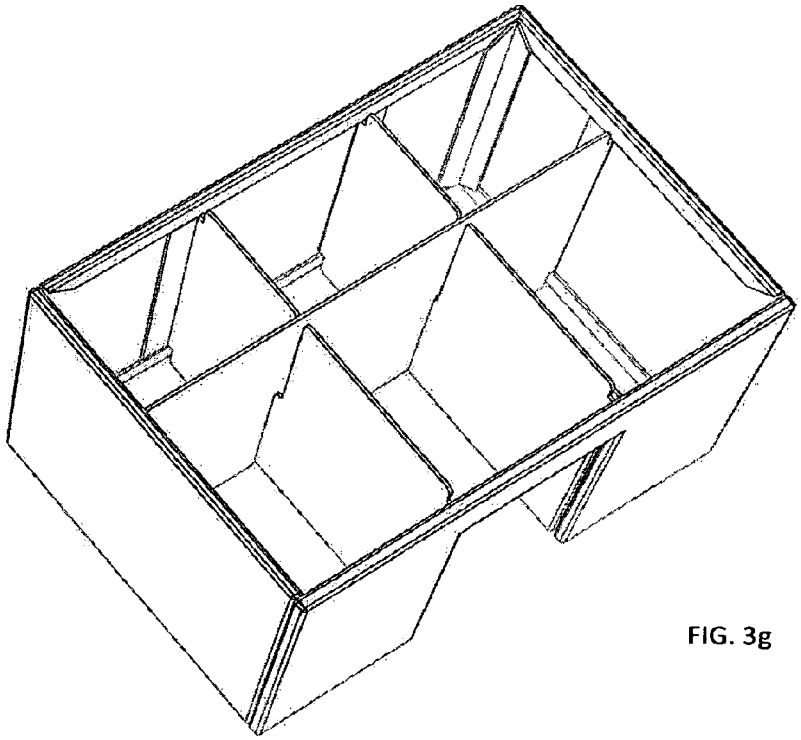
Figure 3H:
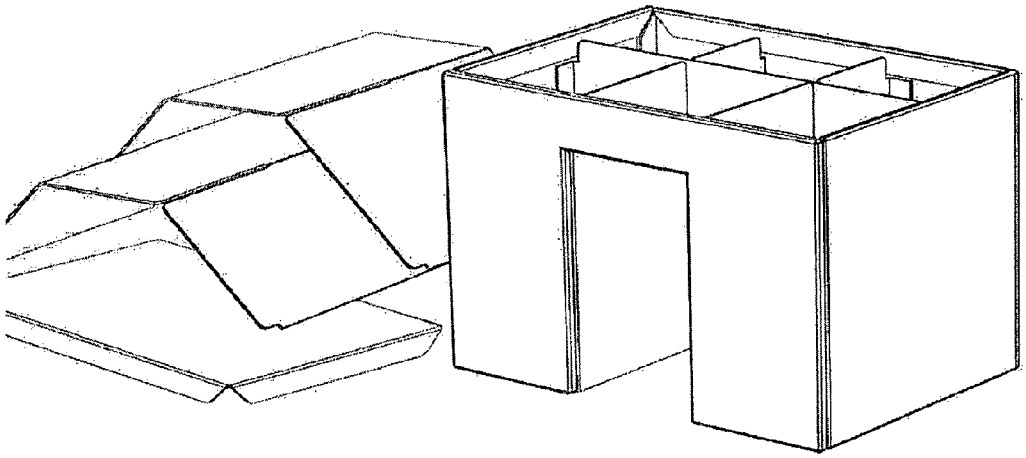
Figure 3I:
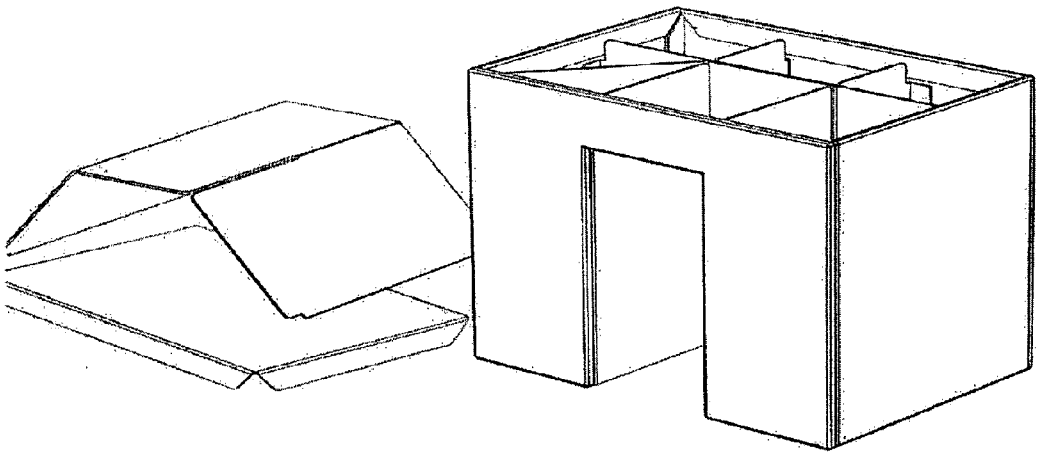
Figure 3J:
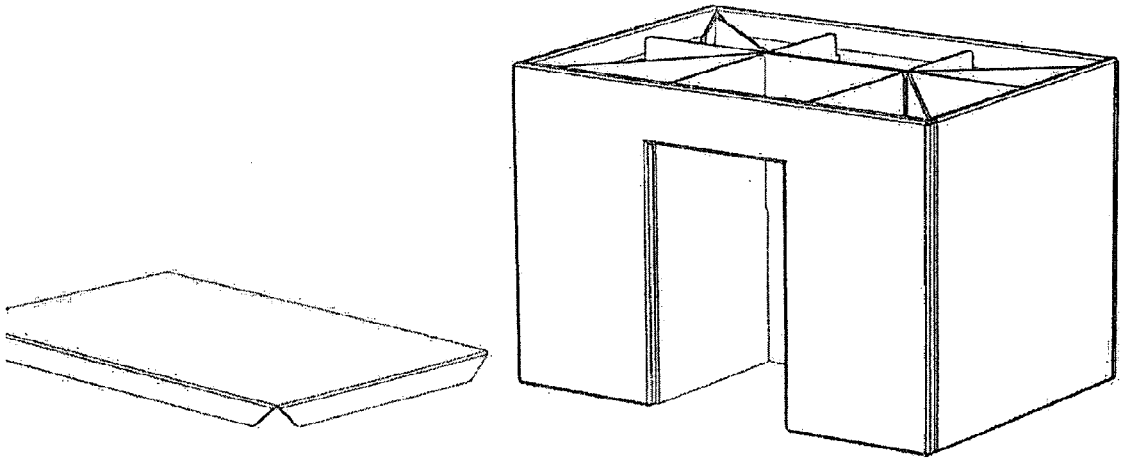
Figure 3K:
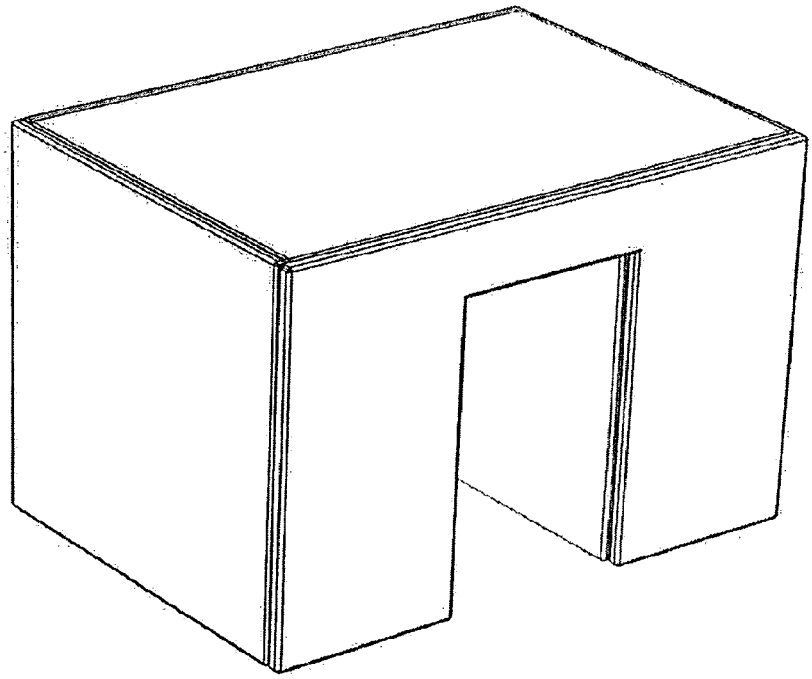

FIG. 3*c* illustrates the various cardboard units included in the kit to produce the desk 300 of FIG. 3*a*. Thus, shown in FIG. 3*c* are: unit 310 defining the front side wall 301 including its opening 301*a*; unit 320 defining the left side wall 302; unit 330 defining the back side wall 303; unit 304 defining the right side wall 304; and unit 350 defining the top wall 305 of the desk. For strengthening purposes, a further cardboard sheet 311 of the same basic shape as the front side wall unit 310 is adhesively bonded to the inner surface and is formed with corrugations extending perpendicular to the corrugations in cardboard sheet 310.

FIG. 3*c* further illustrates the thin connector strips 335, 345, for joining unit 330 to unit 320, and unit 310 to unit 340, respectively. Unit 330 is also joined to unit 340 by the adhesive-coated flaps 333, 343, and unit 320 is also joined to unit 310 by the adhesive-coated flaps 323, 313. These flaps, together with the connector strips 335, 345, are formed with fold lines such that all four units 310-340, when expanded, define the peripheral side wall for the desk. Since the connector strips 335 and 345 are of thinner material than the cardboard sheets units 310-340, the four so-joined units 310-340 may be folded into a flat compact form along the connector strips 335, 345, without unduly straining the folded edges of the respective units.

FIG. 3*c* also illustrates the structural sheets, generally designated 360, to be inserted within the interior of desk 300 to provide structural reinforcement for the desk. These sheets include a longitudinally-extending sheet 361 having adhesive flaps 361*a*, 361*b* at its opposite ends for adhesively bonding to the left and right side walls 302, 304, respectively; and transversely-extending sheets 362, 363 having adhesively-coated flaps 362*a*, 362*b* and 363*a*, 363*b*, respectively, to be bonded to the front side wall 301 and back side wall 303, respectively, of the desk.

As shown in FIG. 3*c*, cardboard sheet 361 is formed with two slots 361*c*, 361*d*, extending for one-half the height of the sheet; whereas cardboard sheets 362 and 363 are each formed with a single slot 362*c*, 363*c*, also extending one-half the height of the respective sheet, but on the opposite side of the sheet as compared to the slot 361. The three sheets 361-363 are assembled in an egg-crate array, as shown in FIG. 3*b*, with sheets 362 and 363 being received within the slots in sheet 361.

FIG. 3*c* illustrates two further cardboard sheets 364, 365. Sheets 364, 365 are not fixed within the desk, but rather are removably received within the desk so as to permit the four joined units 310-340, when the top unit 350 is removed, to be folded into a flat compact form for shipping or storage. Thus, as shown in FIG. 3*b*, when a force is applied to the opposite sides of the joined units 310-340, as indicated by the arrows F, the four joined units will be folded along the fold lines defined by the two thin connector strips 335, 345, into a compact form. To assemble the desk, it is only necessary to expand the four units, by pulling in the opposite direction from the arrows shown in FIG. 3*b*, then inserting the reinforcing sheets 364, 365, and finally applying the desk top panel 350 over the top of the so-expanded unit.

The cardboard sheets illustrated in FIG. 3*c* include not only the first fold lines in the four sheets 310-340 and in the flexible connector strips 335, 345 permitting the cardboard assembly to be folded from the flat condition to a three-dimensional expanded condition, as illustrated in FIG. 3*b* and as described above, but further include the second fold lines spaced inwardly of the viewable edges of the desk defining the flaps 311-341 and 312-342 which are bent inwardly and joined to the inner surfaces of their respective sheets 310-340 such as to present fold lines, rather than cut edges, at the viewable edges of the cardboard assembly, and also to strengthen those edges. The third fold lines included in the previously-described embodiment, namely those permitting the end wall(s) to be folded over the peripheral side wall, are not present in the construction illustrated in FIG. 3*c* since the top wall 350 is provided as a removable element, rather than as one integrally formed in the other sheets and defined by the fold line. However, it will be appreciated that, particularly for smaller tables, the table top 350 could also be integrally formed with one of the side walls and connected thereto by a fold line. The fourth fold lines, namely those spaced inwardly of the outer edges of the top sheet 350, are provided to define bendable flaps receivable against the inner surfaces of the peripheral side wall of the four units 310-340 for frictionally retaining the top wall in place.

The kit illustrated in FIGS. 3*a*-3*k* for producing the desk 300 is otherwise of basically the same construction as described above, and provides the same basic advantages.

Figure 4A:
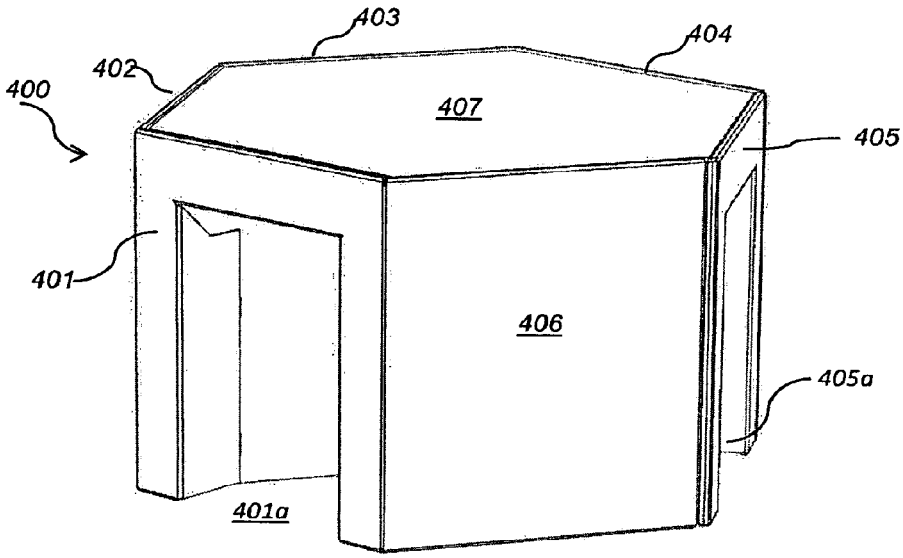
FIGS. 4*a*-4*n* illustrates the various component of a kit for assembling a table, and the various steps in assembling the table.
Figure 4B:
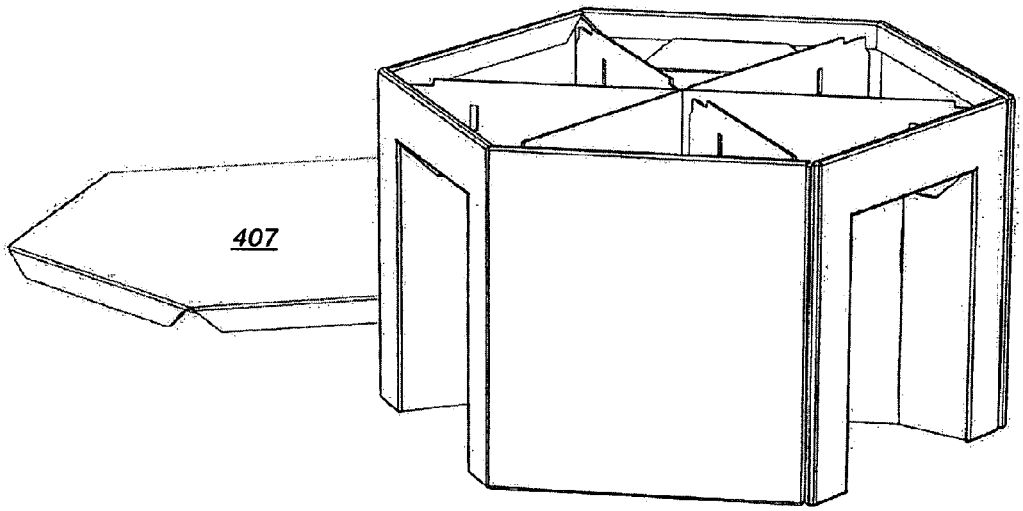
Figure 4C:
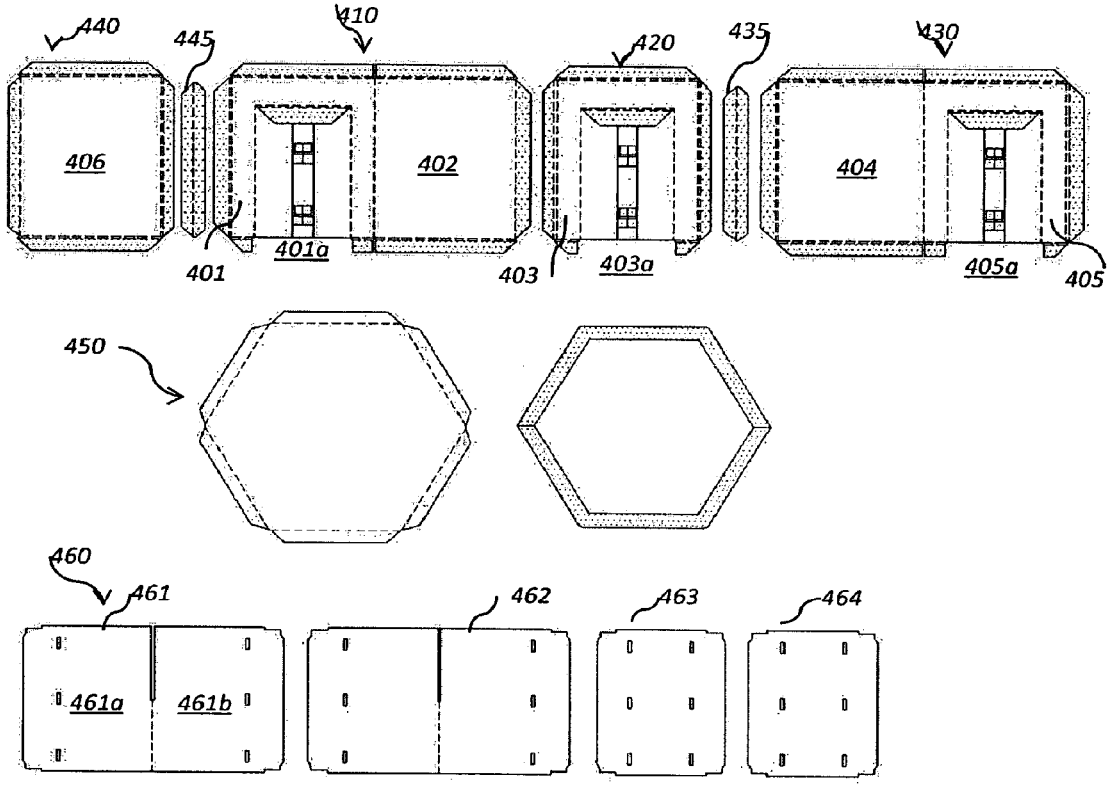
Figure 4D:
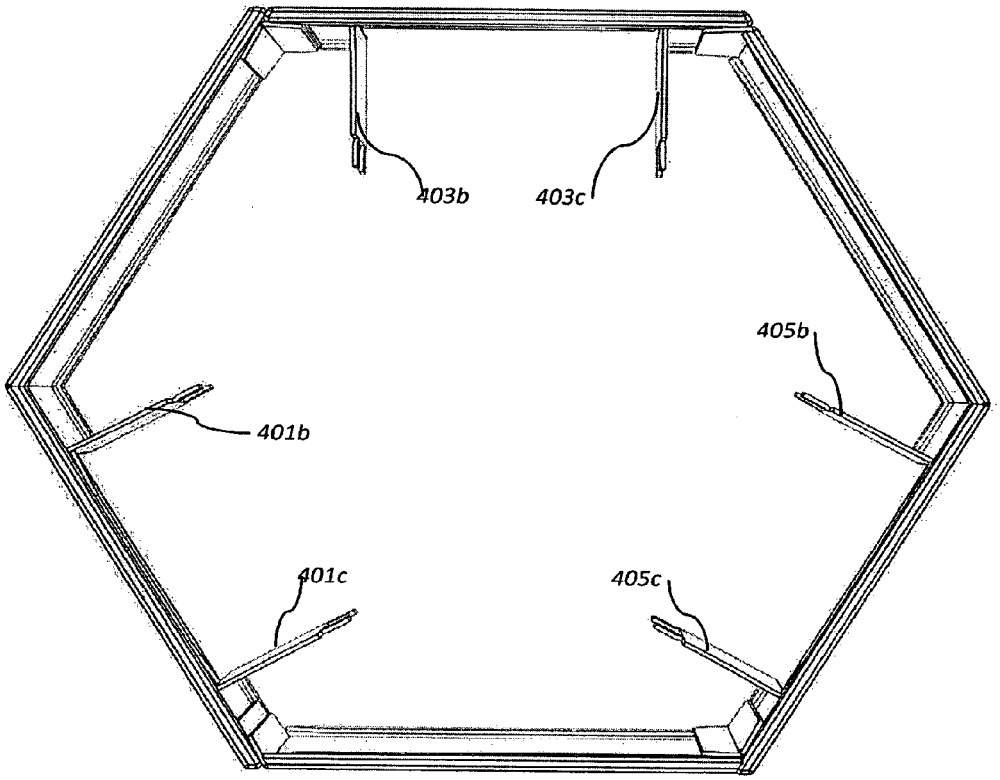
Figure 4E:
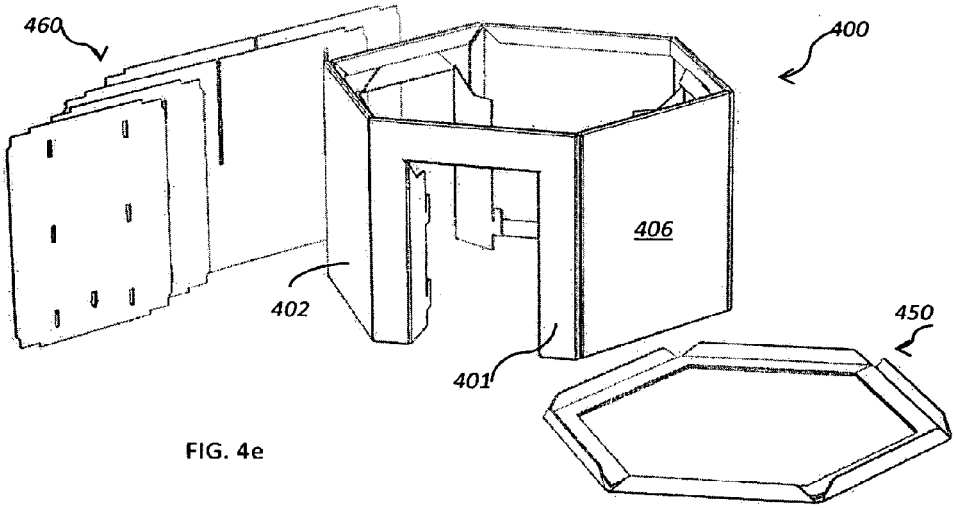
Figure 4F:
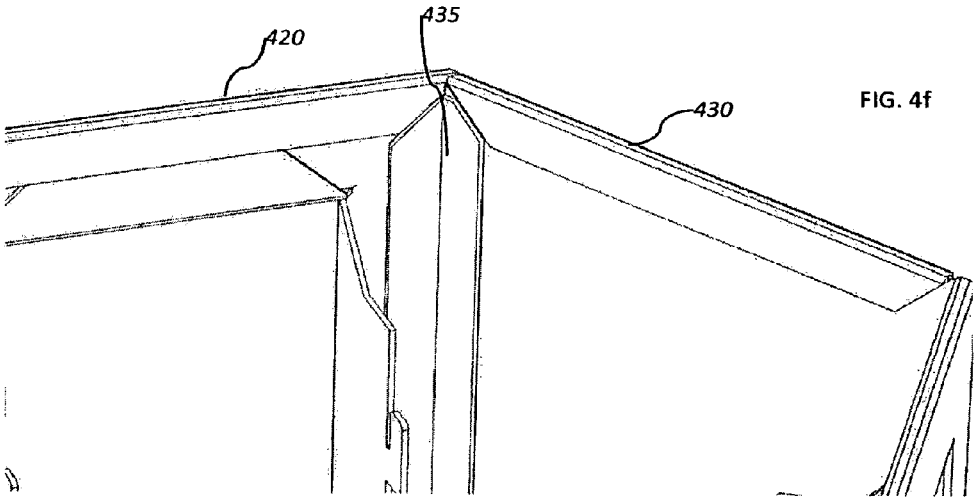
Figure 4G:
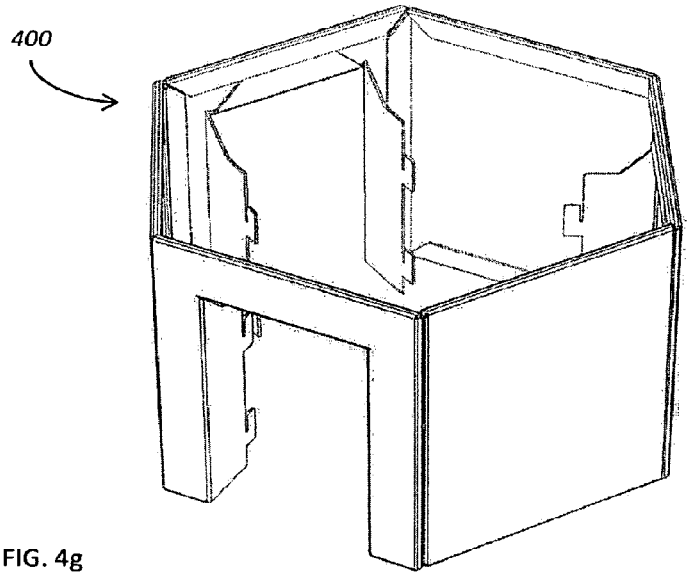
Figure 4H:
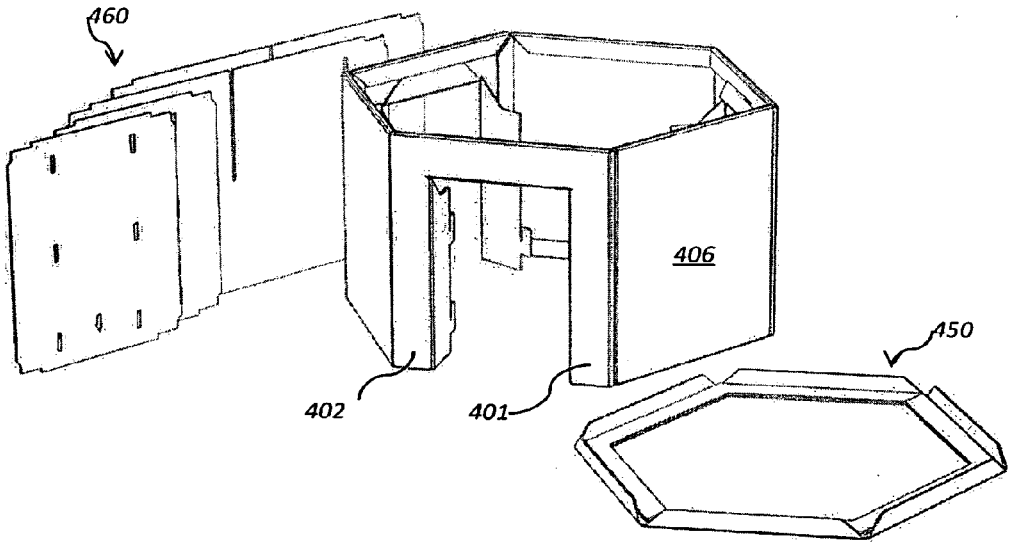
Figure 4I:
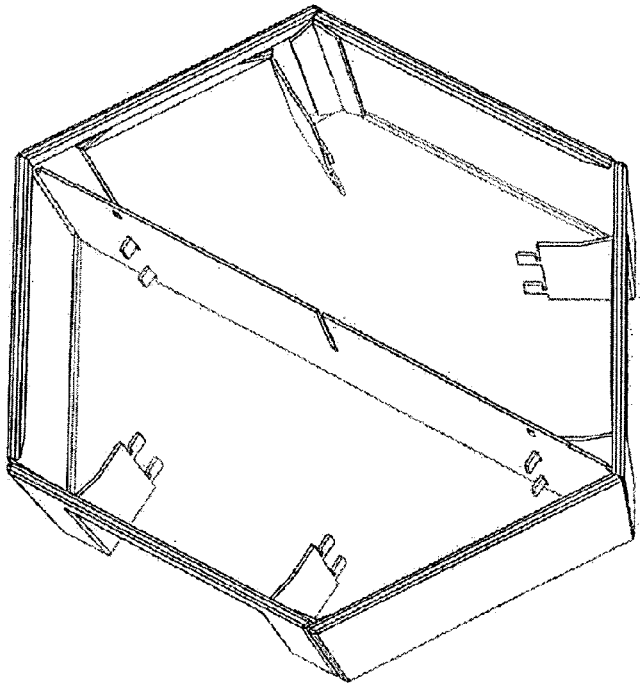
Figure 4J:
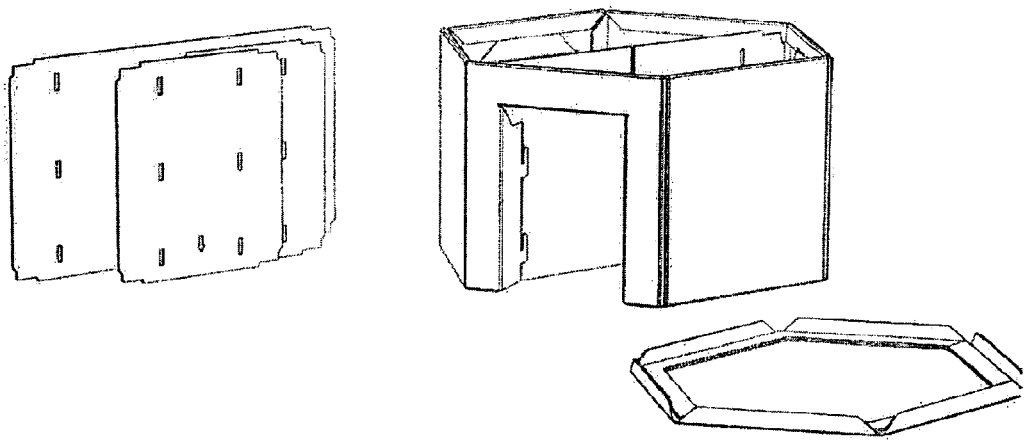
Figure 4K:
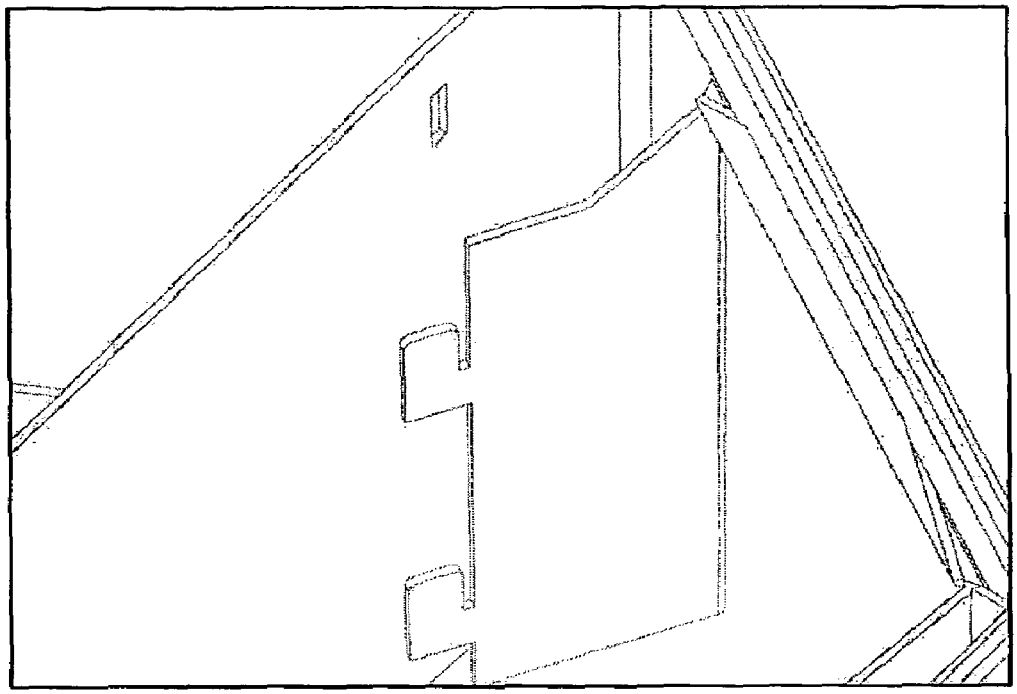
Figure 4L:
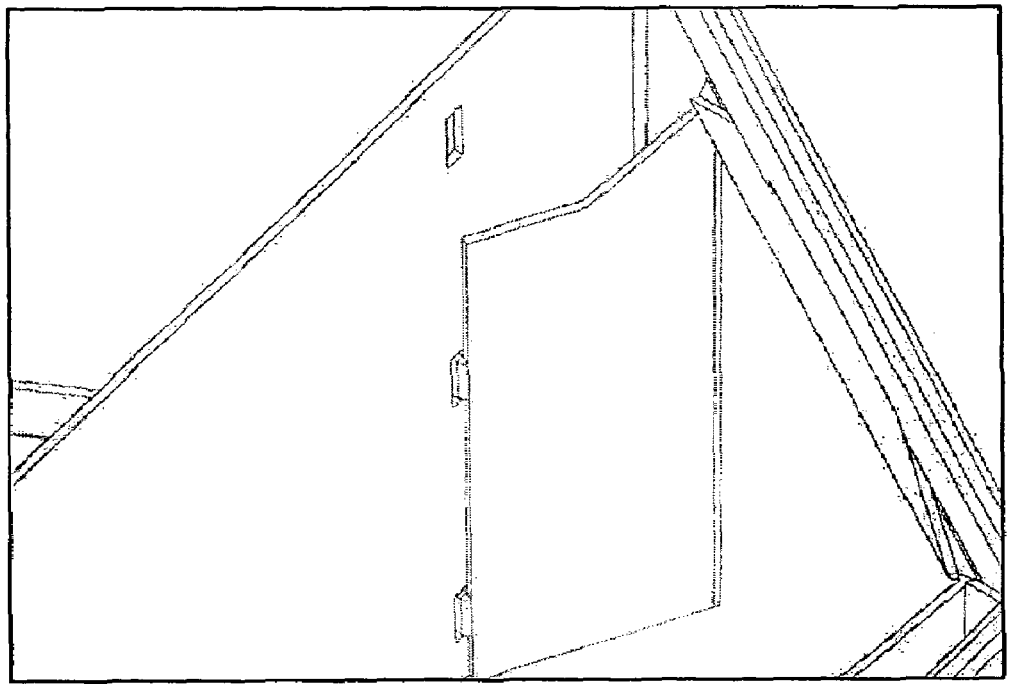
Figure 4M:
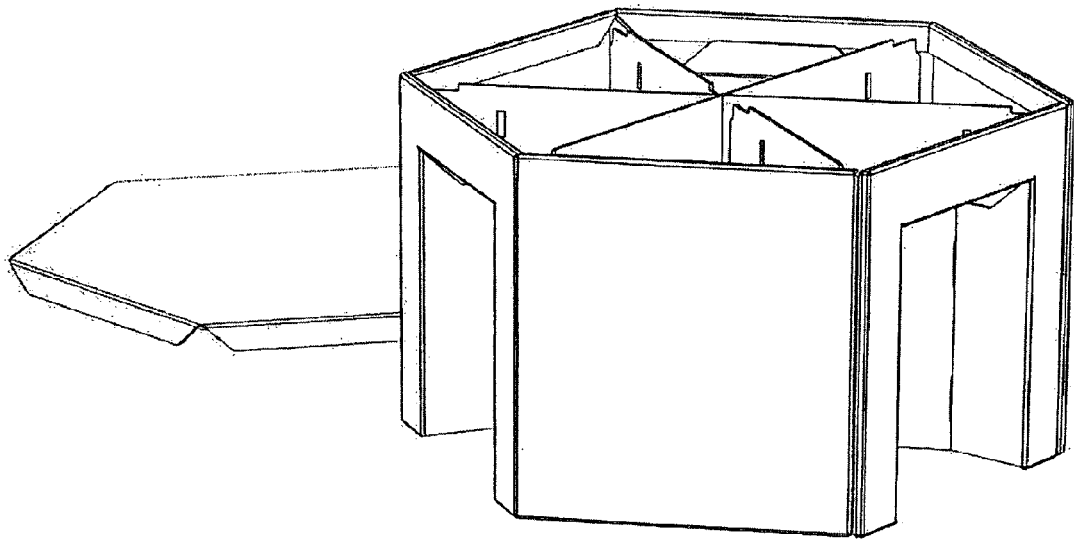
Figure 4N:
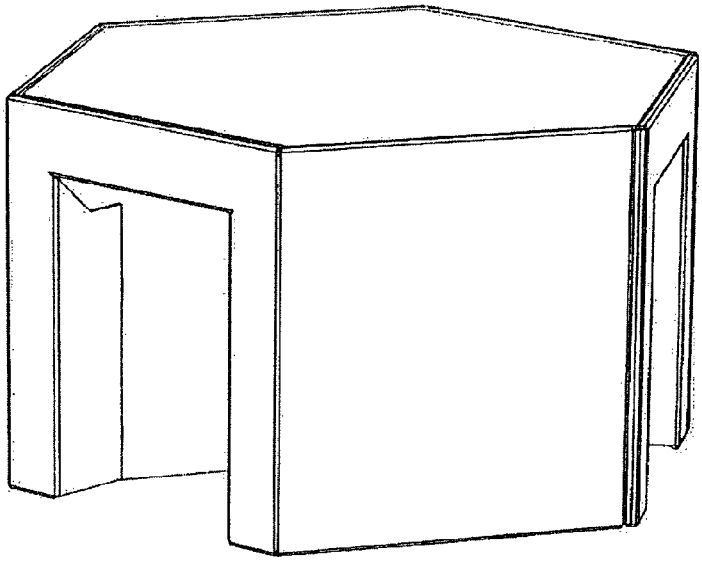

The Table Embodiment (FIGS. 4*a*-4*n*)

FIGS. 4*a*-4*n* illustrates the contents of a cardboard kit for use in assembling a table, generally designated 400, in FIG. 4*a*. The illustrated table is of hexagonal configuration, including six sides 410-406, covered at their upper ends by a table top 407.

Table 400 illustrated in FIG. 4*a* is similar to desk 300 illustrated in FIG. 3*a*, except for its hexagonal shape, and for the provision of openings in three of its side walls, namely openings 401*a*, 403*a* and 405*a* in side walls 401, 403 and 405, respectively, instead of the single opening in desk 300. The other differences between the two kits are more particularly described below.

FIG. 4*c* illustrates, in flat form, the cardboard sheets included in the kit for assembling table 400. These cardboard sheets are included in four units 410, 420, 430 and 440, which are preferably preassembled together at the factory as a subassembly and included in flat compact form in the kit. Units 410-440 define the six sides 401-406 of table 400, as will be described more particularly below.

The kit also includes unit 450 in flat form, which unit serves as the table top 407 of table 400; and unit 460, constituted of four cardboard sheets 461-464, which are inserted within the table, before application of the table top 407, to add structural strength to the assembled table.

As shown in FIG. 4*c*, unit 410 is a relatively long cardboard sheet formed with a middle fold line 410*a* to define the two sides 401, 402; unit 420 is a short cardboard sheet defining side 403; unit 430 is a long cardboard sheet formed with a middle fold line 430*a* defining the two sides 404, 405; and unit 440 is a short cardboard sheet defining side 406. Sides 401, 403 and 405 are formed with the openings 401*a*, 403*a* and 405*a*, respectively. Each of these openings is straddled by an inwardly-extending section of the respective cardboard sheet, as shown in FIG. 4*d* by extensions 401*b*, 401*c* for opening 401*a*; extensions 403*b*, 403*c* for opening 403*a*; and extension 405*b*, 405*c* for opening 405*a*.

The illustrated kit further includes the thin connector strips 435, 445, for assembling the four units 410-440 into the peripheral side wall of the table. Thus, thin connector strip 435 is adhesively joined to one of the ends of units 420 and 430, whereas thin connector strip 445 is adhesively joined to one of the ends of units 440 and 410. The opposite end of unit 410 is adhesively joined directly to the opposite end of unit 420, and the end of unit 430 is adhesively joined directly to the unit 440. As indicated earlier, the use of the thin connector strips 435 and 445 in the so-formed peripheral side wall of the table enables the peripheral side wall to assume a flat compact condition for storage, shipping, handling, etc. Thus, the four units 410-440 may be compactly packaged with the flat table top unit 450, as well as with the flat structural reinforcement sheets 461-464.

The cardboard sheets included in the kit for assembling the table 400 are also formed with fold lines similar to those formed in the cardboard sheets used for assembling the desk 300. Thus, the cardboard sheets illustrated in FIG. 4*c* are formed with the first fold lines, e.g., 410*a*, 430*a*, permitting the cardboard sub-assembly of units 410-440, to be expanded from the flat condition for shipping, to a three-dimensional condition to define the peripheral side walls 401-406 of table 400.

The cardboard sheets illustrated in FIG. 4*c* further include the second fold lines, e.g., 410*b*, spaced inwardly of the viewable edges of the side walls to define flaps which are folded inwardly and adhesively joined to the inner surfaces of the side walls, such as to present fold lines, rather than cut edges, at the viewable edges of the side walls.

Since the table top 407 is defined by unit 450, which is a separate unit from the others (as in the case of desk 300), the cardboard sheets illustrated in FIG. 4*c* do not include the third fold line mentioned above, permitting an extension of one of the cardboard sheets to be folded over the end of the peripheral side wall defined by units 410-440. But such fold lines could be provided as described above with respect to desk 300, particularly for smaller size tables. However, unit 450, defining the table top, includes the fourth fold lines 450*a* spaced inwardly of the outer edge of the table top to define the bendable flaps 451 receivable against the inner surface of the respective end of the peripheral side wall for frictionally retaining the table top in place over the side walls defined by units 441-440.

FIG. 4*c* illustrates a further cardboard sheet 452 in the shape of the outer margins of the table unit 450 for adhesive bonding to its underface for increasing the strength of the assembled table.

Unit 460, including the cardboard sheets 461-464 for structurally supporting the table, are assembled as a radiating array within the table, as shown for example in FIG. 4*m*, rather than as an egg-crate array as shown in FIG. 3*b* in table 300. For this purpose, two of the cardboard sheets 461, 462 are provided with slots extending for one-half their lengths at the mid portions of the respective cardboard sheets such that each defines two sides of the radial array. This is done by inserting the unslotted portion of one sheet into the slotted portion of the other sheet. The two remaining cardboard sheets 463, 464 are then inserted between the four sides defined by cardboard sheets 461, 462, and define the remaining two sides of the six-sided radial array.

Cardboard sheets 461-464 are further formed with openings to receive tabs formed in the inner ends of the extensions 401*b*, 401*c*, 403*b*, 403*c*, 405*b* and 405*c*, straddling the openings in side walls 401, 403 and 405, respectively. These extensions, as well as all the other surfaces of the cardboard sheets which are viewable in the assembled table 400, are colored or otherwise ornamented to thereby provide the assembled table with a very pleasing appearance. It will be appreciated that table 400, in its assembled condition, also does not present cut edges, but rather fold lines, at all the exposed edges of the assembled table, thereby further enhancing the appearance of the assembled table.

The invention has been described above with respect to several preferred embodiments for purposes of example only and it will be appreciated that many variations, modifications and other applications of the invention may be made. For example, while various surfaces are described as being joined by adhesive at the factory, such surfaces could be merely marked for joining with adhesive applied by the purchaser. Also, such surfaces could be merely coated with a moisture-responsive adhesive, such that the purchaser would moisten the respective surfaces and effect the joining. In addition, other methods of joining could be used, for example buttons formed on one surface snappable into sockets formed in the other surface to be joined, or by mechanical "hook and loop" type fasteners (e.g. "Velcro"). Further, while the invention has been described with respect to furniture articles, other types of articles could be assembled, such as receptacles, toys, etc.

Many other variations, modifications and applications of the invention will be apparent.

What is claimed is:

1. A kit for use in forming a three-dimensional article from flat cardboard sheets, comprising:

an assembly of flat cardboard sheets, each cut according to a predetermined configuration and formed with a predetermined arrangement of fold lines such as to permit the cardboard assembly to be expanded from a flat condition to a three-dimensional condition defining a three-dimensional article;

wherein said predetermined arrangement of fold lines includes:

(a) first fold lines permitting the cardboard assembly to be folded from said flat condition to a three-dimensional condition to define a peripheral side wall of the three-dimensional article; and (b) second fold lines spaced inwardly of viewable edges of said peripheral side wall, defining flaps to be bent inwardly and adhesively joined to the inner surface of said peripheral side wall, to present fold lines, rather than cut edges, at the viewable edges of said peripheral side wall; and (c) at least two separate thin flexible connector strips of smaller thickness than that of the cardboard sheets in the cardboard assembly;

wherein said cardboard assembly includes two cardboard sheets joined together at their opposite ends by said thin flexible connector strips, permitting the cardboard assembly to be folded to a flat condition without unduly stressing the fold lines at said opposite ends.

2. The kit according to claim 1, wherein said cardboard assembly includes an extension at least at one end defined by a third fold line, permitting said extension to be folded over the respective end of the peripheral side wall and thereby to constitute an end wall of said peripheral side wall.

3. The kit according to claim 2, wherein said cardboard assembly includes a second extension at the opposite end and defined by another third fold line, permitting said second extension also to be folded over the respective end of the peripheral side wall and thereby to constitute a second end wall thereof; said second extension also including said fourth fold lines spaced inwardly of the outer edges thereof to define bendable flaps receivable against the inner surface at the respective end of the peripheral side wall for retaining said second extension in place as a second end wall of said peripheral side wall.

4. The kit according to claim 1, wherein said cardboard assembly further includes a separate end wall to be applied over said peripheral side wall in the three-dimensional condition of the article, said separate end wall being formed with fourth fold lines spaced inwardly of its outer edges to define bendable flaps receivable against the inner surface of the respective end of the peripheral side wall for retaining said separate end wall in place over said peripheral side wall.

5. The kit according to claim 4, wherein said flaps defined by said second fold lines, and said flaps defined by said fourth fold lines have opposed sides which are inwardly tapered towards their outer edges, to facilitate the bending of said flaps.

6. The kit according to claim 1, wherein said kit comprises further cardboard sheets configured and formed with a predetermined arrangement of slits such as to permit the further cardboard sheets to be inserted within said peripheral side wall such as to structurally reinforce the three-dimensional article.

7. The kit according to claim 6, wherein said further cardboard sheets include at least two cardboard sheets each formed with at least one slot at an intermediate portion thereof extending for a portion of its height, with the other portion of the sheet being unslotted, such as to permit said two sheets to be assembled by inserting the non-slotted portion of one sheet into the slotted portion of the other sheet.

8. The kit according to claim 1, wherein the surfaces of said cardboard sheets which are exposed to view in the three-dimensional article are ornamented.

9. The kit according to claim 1, wherein said cardboard sheets are cut and formed with fold lines to define a stool in the three-dimensional condition of the cardboard assembly.

10. The kit according to claim 9, wherein said kit comprises further cardboard sheets configured and formed with a predetermined arrangement of slits such as to permit the further cardboard sheets to be assembled within said stool such as to structurally reinforce the stool.

11. The kit according to claim 9, wherein said cardboard sheets are cut and formed with fold lines to define a chair having a seat section and a backrest section in the three-dimensional condition of the cardboard assembly.

12. The kit according to claim 11, wherein said kit comprises further cardboard sheets configured and formed with a predetermined arrangement of slits such as to permit the further cardboard sheets to be assembled in an egg-crate array within said seat section of the chair and to structurally reinforce the chair.

13. The kit according to claim 12, wherein some of said further cardboard sheets are of longer height than others and extend into said backrest section of the chair.

14. The kit according to claim 1, wherein said cardboard sheets are cut and formed with fold lines to define, in the three-dimensional condition of the cardboard assembly, a desk having an opening at one side for accommodating a chair or the legs of a user sitting on a chair.

15. The kit according to claim 14, wherein said kit comprises further cardboard sheets configured and formed with a predetermined arrangement of slits such as to permit the further cardboard sheets to be assembled within said desk such as to structurally reinforce the desk.

16. The kit according to claim 15, wherein said desk is of rectangular configuration and has a length greater than its width; and wherein said further cardboard sheets define an egg-crate array and include a long cardboard sheet extending along the length of the desk, and shorter cardboard sheets extending across the width of the desk.

17. The kit according to claim 1, wherein said cardboard sheets are cut and formed with fold lines to define a table of polygonal shape having "n" sides.

18. The kit according to claim 1, wherein said cardboard sheets are of corrugated cardboard, said kit including further cardboard sheets receivable within said table in a radiating array to structurally reinforce said three- dimensional article, and at least one further corrugated cardboard sheet joined to, or to be joined to, one of said corrugated cardboard sheets and having corrugations perpendicular to said one cardboard sheet for strengthening said three-dimensional article.

19. A cardboard product made by assembling the kit of claim 1.

* * * * *